United States Patent [19]

Kubo et al.

[11] Patent Number: 4,789,605

[45] Date of Patent: Dec. 6, 1988

[54] COMPOSITE MATERIAL WITH LIGHT MATRIX METAL AND WITH REINFORCING FIBER MATERIAL BEING SHORT FIBER MATERIAL MIXED WITH POTASSIUM TITANATE WHISKERS

[75] Inventors: Masahiro Kubo; Tadashi Dohnomoto; Atsuo Tanaka, all of Toyota; Hidetoshi Hirai, Kariya, all of Japan

[73] Assignee: Toyota Jidosha Kabushiki Kaisha, Toyota, Japan

[21] Appl. No.: 32,710

[22] Filed: Mar. 31, 1987

[30] Foreign Application Priority Data

Apr. 11, 1986 [JP] Japan ..... 61-083750

[51] Int. Cl.[4] ..... B32B 15/14

[52] U.S. Cl. ..... 428/614

[58] Field of Search ..... 428/614; 164/97; 123/193 P

[56] References Cited

U.S. PATENT DOCUMENTS

| | | | |
|---|---|---|---|
| 3,455,662 | 7/1969 | Alexander | 428/614 |
| 3,691,623 | 9/1972 | Staudhammer et al. | 428/614 |
| 4,452,865 | 6/1984 | Yamatsuta et al. | 148/11.5 Q |
| 4,590,132 | 5/1986 | Dohnomoto et al. | 428/614 |
| 4,601,956 | 7/1986 | Dohnomoto et al. | 428/614 |
| 4,694,735 | 9/1987 | Tatematsu et al. | 92/208 |

FOREIGN PATENT DOCUMENTS

| | | | |
|---|---|---|---|
| 208033 | 11/1984 | Japan | 164/97 |

OTHER PUBLICATIONS

Heat-Resistant Light Alloy Composite Parts, Chemical Abstracts 101:96183q, Apr. 16, 1984.

Heat-Resistant Light Alloy Composite Parts, Chemical Abstracts 101:96184r, Apr. 16, 1984.

Tank et al., Pistons from Magnesium or Its Alloys for Internal Combustion Engines, Chemical Abstracts 102:83068b, Oct. 18, 1984.

Hamajima et al., Short Fiber Preform for Composite Material, Chemical Abstracts 105:177102x, Aug. 6, 1986.

*Primary Examiner*—John J. Zimmerman

*Attorney, Agent, or Firm*—Finnegan, Henderson, Farabow, Garrett & Dunner

[57] ABSTRACT

A composite material is made from reinforcing fiber material embedded in a matrix of metal. The matrix metal is a light metal such as aluminum alloy or magnesium alloy. The reinforcing fiber material is a mixture of potassium titanate whiskers and a short fiber material, which is one or a mixture of: silicon carbide whiskers, silicon nitride whiskers, alumina short fibers, crystalline alumina-silica short fibers, and amorphous alumina-silica short fibers. The overall volume proportion of the reinforcing fiber material in the composite material is between approximately 5% and approximately 50%, and more desirably may be between approximately 5% and approximately 40%, and even more desirably may be between approximately 10% and approximately 40%. And the relative volume proportion of the potassium titanate whiskers in the reinforcing fiber material is from about 10% to about 80%, and more desirably may be between approximately 10% and approximately 70%, and even more desirably may be between approximately 20% and approximately 60%.

9 Claims, 19 Drawing Sheets

COMPOSITE MATERIAL WITH LIGHT MATRIX METAL AND WITH REINFORCING FIBER MATERIAL BEING SHORT FIBER MATERIAL MIXED WITH POTASSIUM TITANATE WHISKERS

BACKGROUND OF THE INVENTION

The present invention relates to a composite material made up from reinforcing fibers embedded in a matrix of metal, and more particularly relates to such a composite material utilizing a mixture of potassium titanate whiskers and short fiber type material as the reinforcing fiber material, and a light metal as the matrix metal, i.e. to a partially potassium titanate whisker reinforced composite material.

Further, the present inventors wish hereby to attract the attention of the examining authorities to copending U.S. patent application Ser. Nos. 734655, 735068, 734654 now U.S. Pat. Nos. 4,601,956 and 4,664,704 and 4,595,638 respectively, and Ser. No. 901196, which may be considered to be material to the examination of the present patent application.

Previous reseach relating to composite materials incorporating reinforcing fibers has evolved the ideas of utilizing as such reinforcing fiber material such materials as silicon carbide whiskers, silicon nitride whiskers, alumina short fibers, crystalline alumina-silica short fibers (aluminia-silica short fibers including mullite crystals), and amorphous alumina-silica short fibers. Such concepts are mulled in, for example, the specifications of Japanese patent application Ser. Sho. Nos. 60-120786 (1985), Sho. 60-120787 (1985), Sho. 60-120788 (1985), Sho. 60-193415 (1985), Sho. 60-19793 (1985), and Sho. 60-24539 (1985), corresponding to U.S. application Ser. No. 868,542, filed May 30, 1986; Ser. No. 868,750, filed May 30, 1986; Ser. No. 868,541, filed May 30, 1986; Ser. No. 895,811, filed Aug. 12, 1986; Ser. No. 007,790, filed Jan. 28, 1987; and Ser. No. 011,924 filed Feb. 6, 1987, respectively, among others, all of which Japanese patent applications were filed by an applicant the same as the applicant of the parent Japanese patent application of which Convention priority is being claimed for the present patent application, and none of which above identified documents is it hereby intended to admit as prior art to the present patent application except to the extent in any case otherwise mandated by applicable law. And, utilizing such above identified short fiber materials as reinforcing fiber material, in said publications, for example, there have been disclosed efforts to fabricate composite materials having enhanced strength and wear resistance, as well as other desirable properties.

Further, as described, for example, in pages 66 through 71 of Vol. 8, Issue 2 of the Publication of the Japanese Composite Material Assocation for 1982, potassium titanate whiskers are per se known and are a short fiber material; and in some cases attempts have been made to utilize such potassium titanate whisker as reinforcing material for composite materials which are to be reinforced with fibrous material.

However, with regard to composite materials utilizing as reinforcing fiber material such fiber materials as identified above, i.e. utilizing as reinforcing fiber material silicon carbide whiskers, silicon nitride whiskers, alumina short fibers, crystalline alumina-silica short fibers, or amorphous alumina-silica short fibers, alothough they have admirable and intriguing properties at room temperature, they are fraught with the basic disadvantage that their strength is considerably deteriorated at higher temperatures such as at temperatures around about 250° C. Consequently, application of such fiber reinforced composite materials to high temperature applications has been impracticable.

SUMMARY OF THE INVENTION

The inventors of the present application have considered the above mentioned problems in composite materials which use such fiber materials as reinforcing fiber material for their matrix metals, and have discovered that, by admixturing a certain proportion of potassium titanate whisker material into such fiber materials, and by using the resultant hybrid fiber material as reinforcing fiber material for a matrix metal of a light type such as aluminum or magnesium alloy, it is possible to obtain a composite material having relatively high strength both at room temperature and at higher temperatures such as at temperatures around about 250° C. The present invention is based on the knowledge obtained from the results of the various experimental researches carried out by the inventors of the present application, as will be detailed later in this specification.

Accordingly, it is the primary object of the present invention to provide a composite material utilizing a fibrous reinforcing material embedded in a matrix metal, which enjoys superior mechanical characteristics such as bending strength, both at room temperatures and at higher temperatures such as at temperatures around about 250° C.

It is a further object of the present invention to provide such a composite material, which is relatively inexpensive.

It is a further object of the present invention to provide such a composite material, which utilizes as little reinforcing material as is practicable without deteriorating its characteristics unduly.

According to the most general aspect of the present invention, these and other objects are attained by a composite material comprising a mass of reinforcing fiber material embedded in a matrix of metal; said reinforcing fiber material being a mixture of potassium titanate whiskers and a short fiber material; said matrix metal being a light metal; said short fiber material being selected from the group consisting of silicon carbide whiskers, silicon nitride whiskers, alumina short fibers, crystalline alumina-silica short fibers, amorphous alumina-silica short fibers, and mixtures thereof; the overall volume proportion of said reinforcing fiber material in said composite material being from about 5% to about 50%; and the relative volume proportion of said potassium titanate whiskers in said reinforcing fiber material being from about 10% to about 80%.

According to the present invention as described above, as reinforcing fiber material there is used a mixture of potassium titanate whiskers and a short fiber material such as silicon carbide whiskers, silicon nitride whiskers, alumina short fibers, crystalline alumina-silica short fibers, amorphous alumina-silica short fibers, or a mixture incorporating two or more of these above identified short fiber materials; and, provided that as specified above the overall volume proportion of said reinforcing fiber material in said composite material is from about 5% to about 50%, and the relative volume proportion of said potassium titanate whiskers in said reinforcing fiber material is from about 10% to about 80%., as will become clear from the results of experimental research carried out by the inventors of the present application as will be described below, a composite material with superior mechanical characteristics such as strength, both at room temperature and at high temperatures such as at temperatures around about 250° C. can be obtained.

Now in the present invention as specified above potassium titanate whiskers are used as an essential component for the reinforcing fiber material, and, as will become clear from the results of the experimental researches carried out by the inventors of the present application as will be described below, such potassium titanate whisker material reacts moderately with aluminum and/or magnesium at high temperatures, to thereby enhance its adherence to a matrix metal which is a light metal or metal alloy containing either or both of these elements. According to one particular detailed characteristic of the present invention, therefore, said light metal which is the matrix metal contains aluminum, i.e. is an alloy of aluminium; and, according to another alternative particular detailed characteristic of the present invention, said light metal which is the matrix metal contains magnesium, i.e. is an alloy of magnesium.

Furthermore, in a composite material including such a mixed or hybrid type reinforcing fiber material which is made as a mixture of potassium titanate whiskers and any one or a mixture of the above specified other fiber materials, as also will become clear from the experimental researches given hereinafter, while the overall strength of the composite material of course increases as the overall volume proportion of the mixed hybrid reinforcing fiber material in said composite material is increased, especially in the particular ranges where said overall volume proportion of said mixed hybrid reinforcing fiber material is between about 5% and about 10% and is between about 30% and about 40%, still, in the range where said overall volume proportion of said mixed hybrid reinforcing fiber material is less than about 5%, the effectiveness of composite reinforcement of the composite material is relatively low and a sufficient strength cannot be obtained, while on the other hand in the range where said overall volume proportion of said mixed hybrid reinforcing fiber material is greater than about 50% or 40% the rate of increase in the strength of the composite material along with increase in the proportion of said mixed hybrid reinforcing fiber material is lower than in the intermediate range where said overall volume proportion of said mixed hybrid reinforcing fiber material is between about 5% and about 40% or 50%. In general, it is desirable to minimize the amount of reinforcing fiber utilized in the composite material, to the end of minimizing the total cost of the composite material, since the cost of such reinforcing fiber gives rise to a major cost component of the finished composite material. Therefore, according to one detailed characteristic of the present invention, the volume proportion of the mixed hydrid reinforcing fiber material is required to be in the range of from approximately 5% to approximately 50%, and more preferably is required to be in the range of from approximately 5% to approximately 40%, and even more preferably is required to be in the range of from approximately 10% to approximately 40%.

Furthermore, with regard to strength of the composite material at room temperature, as also will become clear from the experimental researches performed by the present inventors and detailed hereinafter, in a composite material including such a mixed or hybrid type reinforcing fiber material which is made as a mixture of potassium titanate whiskers and any one or a mixture of the above specified other fiber materials, although the strength at room temperature of said composite material in general decreases as the relative volume proportion of the potassium titanate whisker material in the mixed hybrid reinforcing fiber material in said composite material is increased, nevertheless, in the range where said relative volume proportion of said potassium titanate whisker material in said mixed hybrid reinforcing fiber material is less than about 70%, and particularly in the more restricted range where said relative volume proportion of said potassium titanate whisker material in said mixed hybrid reinforcing fiber material is less than about 60%, the strength at room temperature of said composite material is approximately the same as that of a composite material containing only the admixtured short fiber material without any potassium titanate whisker material mixed in therewith, and is therefore not significantly deteriorated by the presence of the admixtured potassium titanate whisker material. However, in the range where said relative volume proportion of said potassium titanate whisker material in said mixed hybrid reinforcing fiber material is greater than about 70%, and particularly in the more restricted range where said relative volume proportion of said potassium titanate whisker material in said mixed hybrid reinforcing fiber material is greater than about 80%, the strength at room temperature of said composite material is much reduced as compared to that of a composite material containing only. the admixtured short fiber material without any potassium titanate whisker material mixed in therewith, and also rapidly drops along with further increase in said relative volume proportion of said potassium titanate whisker material. Further, with regard to strength of such a composite material at high temperatures, as also will become clear from the experimental researches performed by the present inventors and detailed hereinafter, although the strength at high temperatures of said composite material in general increases as the relative volume proportion of the potassium titanate whisker material in the mixed hybrid reinforcing fiber material in said composite material is increased, nevertheless, in the range where said relative volume proportion of said potassium titanate whisker material in said mixed hybrid reinforcing fiber material is greater than about 10%, and particularly in the more restricted range where said relative volume proportion of said potassium titanate whisker material in said mixed hybrid reinforcing fiber material is greater than about 20%, the strength at high temperatures of said composite material is approximately the same as that of a composite material containing only potassium titanate whisker material without any of the admixtured short fiber material mixed in therewith, and is therefore not significantly deteriorated by the presence of the admixtured short fiber material. However, in the range where said relative volume proportion of said potassium titanate whisker material in said mixed hybrid reinforcing fiber material is less than about 20%, and particularly in the more restricted range where said relative volume proportion of said potassium titanate whisker material in said mixed hybrid reinforcing fiber material is less than about 10 %, the strength at high temperatures of said composite material is much reduced as compared to that of a composite material containing only the potassium titanate whisker material without any admixtured short fiber material mixed in therewith, and also rapidly drops along with further increase in said relative volume proportion of said admixtured short fiber material. Therefore, according to another detailed characteristic of the present invention, the relative volume proportion of the potassium titanate whisker material in the mixed hydrid reinforcing fiber material is required to be in the range of from approximately 10% to approximately 80%, and more preferably is required to be in the range of from approximately 10% to approximately 70%, and even more preferably is required to be in the range of from approximately 20% to approximately 60%.

It should be noted that in the specification all percentages, except in expressions of volume proportion of reinforcing fiber material (both relative and absolute), are percentages by weight. It should further be noted that, in this specification, in descriptions of ranges of compositions, temperatures and the like, the expressions "at least", "not less than", "at most", "no more than", and "from . . . to . . . " and so on are intended to include the boundary values of the respective ranges.

BRIEF DESCRIPTION OF THE DRAWINGS

The present invention will now be described with respect to the preferred embodiments thereof, and with reference to the illustrative drawings appended hereto, which however are provided for the purposes of explanation and exemplification only, and are not intended to be limitative of the scope of the present invention in any way, since this scope is to be delimited solely by the accompanying claims. With relation to the figures, spatial terms are to be understood as referring only to the orientation on the drawing paper of the illustrations of the relevant elements, unless otherwise specified; like reference numerals, unless otherwise so specified, denote the same elements and so on in the various figures; and:

DESCRIPTION OF THE PREFERRED EMBODIMENTS

The present invention will now be described with reference to the various preferred embodiments thereof, and with reference to various comparison examples not according to the present invention. It should be noted that all of the tables referred to in this specification are to be found at the end of the specification and before the claims thereof; the present specification is arranged in such a manner in order to maximize ease of pagination. Further, the preferred embodiments of the present invention are conveniently divided into nine groupings of sets thereof along with comparison examples, as will be seen in what follows.

THE FIRST SET OF PREFERRED EMBODIMENTS (hybrid fibers-mixture of silicon nitride whiskers and potassium titanate whiskers; matrix metal-aluminum alloy; overall fiber volume proportion 30%)

In order to assess what might be the most suitable range for the potassium titanate whisker relative volume proportion in a reinforcing hybrid fiber mixture for a contemplated composite material of the type described in the preamble to this specification, in the case of the short fiber material which was to be admixtured to potassium titanate whisker material to form said reinforcing hybrid fiber mixture being chosen to be silicon nitride whisker material, the present inventors manufactured by using the high pressure casting method samples of various composite materials, utilizing as reinforcing material various hybrid fiber mixtures containing uniformly mixed together in various proportions silicon nitride whiskers and potassium titanate whiskers; and the present inventors utilized in these composite materials three different types of aluminum alloys of various compositions as matrix metals, to wit aluminum alloys of types JIS standard AC1A, JIS standard AC4C, and JIS standard AC7A. Then the present inventors conducted evaluations of the bending strength of the various resulting composite material sample pieces, both at room temperature and at a high temperature of approximately 250° C.

Figure 18:
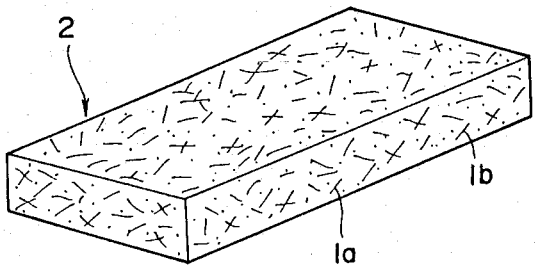
FIG. 18 is a perspective view of a preform made of mixed hybrid type short fiber material, with said hybrid short fibers being aligned substantially randomly in three dimensions, for incorporation into composite materials according to various preferred embodiments of the present invention.

In detail, first, six quantities, denoted hereinafter as A1 through A6, of mixed hybrid fiber material were made by mixing together silicon nitride whisker material (manufactured by Tateho Kagaku K.K.) which had composition at least 99% of alpha-$Si_3N_4$ and which had average fiber length about 150 microns and average fiber diameter about 1 micron, and potassium titanate whisker material (manufactured by Ootsuka Kagaku Yakuhin K.K.) which had composition substantially 100% of $K_2O{\cdot}6TiO_2$ and which had average fiber length about 150 microns, in the respective relative volume proportions of 1:0, 4:1, 3:2, 2:3, 1:4, and 0:1, i.e. so that the potassium titanate whisker relative volume proportion therein was respectively 0%, 20%, 40%, 60%, 80%, and 100%. The composition of each of these six quantities A1 through A6 of mixed hybrid fiber material is shown in Table 1. Then, from each of these six mixed hybrid fiber material quantities A1 through A6, there were formed three preforms by, in each case, subjecting a quantity of the relevant mixed hybrid fiber material to compression forming; thus, in all, there were eighteen such preforms. Each of these eighteen mixed hybrid fiber material preforms, as schematically illustrated in perspective view in FIG. 18 wherein an exemplary such preform is designated by the reference numeral 2 and the short fibers therein are generally designated as 1*a* while the potassium titanate whiskers therein are designated as 1*b*, was about 100×38×16 mm in dimensions, and the individual short fibers and potassium titanate whiskers in said preform 2 were oriented in a substantially three dimensionally random manner. And the overall mixed hybrid fiber material volume proportion in each of said preforms 2, in this first set of preferred embodiments of the composite material of the present invention, was approximately 30%.

Figure 19:
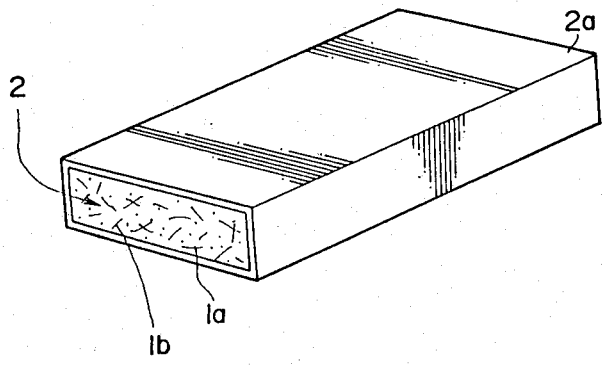
FIG. 19 is a perspective view showing said preform made of mixed hybrid type short fiber material enclosed in a stainless steel case both ends of which are open, for incorporation into said composite materials.
Figure 20:
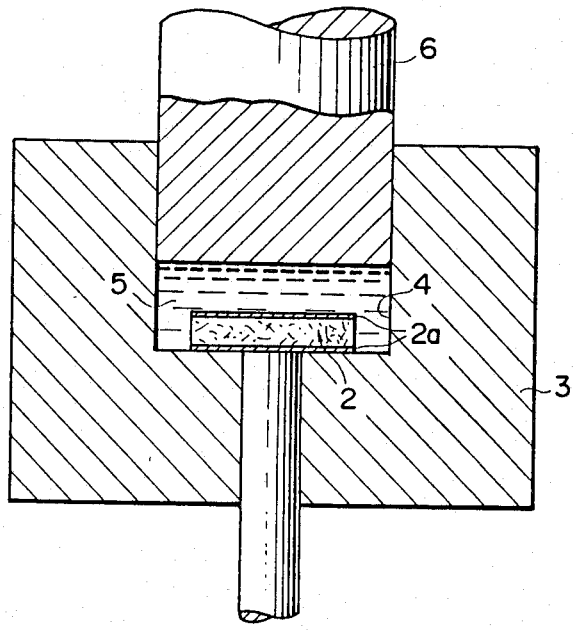
FIG. 20 is a schematic sectional diagram showing a high pressure casting device in the process of performing high pressure casting for manufacturing a composite material with the mixed hybrid type short fiber material preform of FIGS. 18 and 19 (enclosed in its stainless steel case) being incorporated in a matrix of matrix metal.

Next, each of these mixed hybrid fiber material preforms 2 was subjected to high pressure casting together with an appropriate quantity of one of the three aluminum alloys AC1A, AC4C, or AC7A detailed above, in the following manner. First, the preform 2 was was inserted into a stainless steel case 2*a*, as shown in perspective view in FIG. 19, which was about 100×38×16 mm in internal dimensions and had both of its ends open. After this, each of these stainless steel cases 2*a*, with its preform 2 held inside it was heated up to a temperature of approximately 600° C., and then as shown in schematic sectional view in FIG. 9 said case 2*a* and the preform 2 held inside it were placed within a mold cavity 4 of a casting mold 3, which itself had previously been preheated up to a temperature of approximately 250° C. Next, a quantity 5 of the appropriate one of the aluminum alloys detailed above, molten and maintained at a temperature of approximately 710° C. in the case of the aluminum alloys AC1A and AC4C and at a temperature of approximately 700° C. in the case of the aluminum alloy AC7A, was relatively rapidly poured into said mold cavity 4, so as to surround the case 2*a* and the preform 2 therein, and then a pressure plunger 6, which itself had previously been preheated up to a temperature of approximately 200° C., and which closely cooperated with the upper portion of said mold cavity 4, was inserted into said upper mold cavity portion, and was pressed downwards by a means not shown in the figure so as to pressurize said molten aluminum alloy quantity 5 and said case 2*a* and said preform 2 submerged thereunder to a pressure of approximately 1000 kg/cm$^2$. Thereby, the molten aluminum alloy was caused to percolate into the interstices of the mixed hybrid fiber material preform 2. This pressurized state was maintained until the quantity 5 of molten aluminum alloy had completely solidified, and then the pressure plunger 6 was removed and the solidified aluminum alloy mass with the stainless steel case 2*a* and the preform 2 included therein was removed from the casting mold 3, and the peripheral portion of said solidified aluminum alloy mass and also the stainless steel case 2*a* were machined away, leaving only a sample piece of composite material which had the relevant one of the mixed hybrid fiber materials as reinforcing material and the relevant one of the above detailed aluminum alloys as matrix metal. The volume proportion of mixed hybrid fiber material in each of the resulting composite material sample pieces thus produced was therefore approximately 30%.

Next the following post processing steps were performed on the composite material samples. First: those of said composite material samples which incorporated the JIS standard AC1A aluminum alloy matrix metal were subjected to solution treatment at a temperature of approximately 510° C. for approximately 8 hours, and then were subjected to artificial aging treatment at a temperature of approximately 160° C. for approximately 8 hours; those of said composite material samples which incorporated the JIS standard AC4C aluminum alloy matrix metal were subjected to solution treatment at a temperature of approximately 525° C. for approximately 8 hours, and then were subjected to artificial aging treatment at a temperature of approximately 160° C. for approximately 6 hours; while those of said composite material samples which incorporated the JIS standard AC7A aluminum alloy matrix metal were not subjected to any particular heat treatment. Then, in each set of cases, from each of the composite material sample pieces manufactured as described above, there was cut a bending strength test piece of length approximately 50 mm, width approxiately 10 mm, and thickness approximately 2 mm, and for each of these composite material bending strength test pieces a three point bending strength test was carried out, with a gap between supports of approximately 40 mm. In these bending strength tests, the bending strength of the composite material bending strength test pieces was measured as the surface stress at breaking point M/Z (M is the bending moment at the breaking point, while Z is the cross section coefficient of the composite material bending strength test piece). And these experiments and measurements were repeated twice: once with the temperature of the composite material bending strength test pieces being room temperature and once with the temperature of said composite material bending strength test pieces being approximately 250° C.

Figure 1:
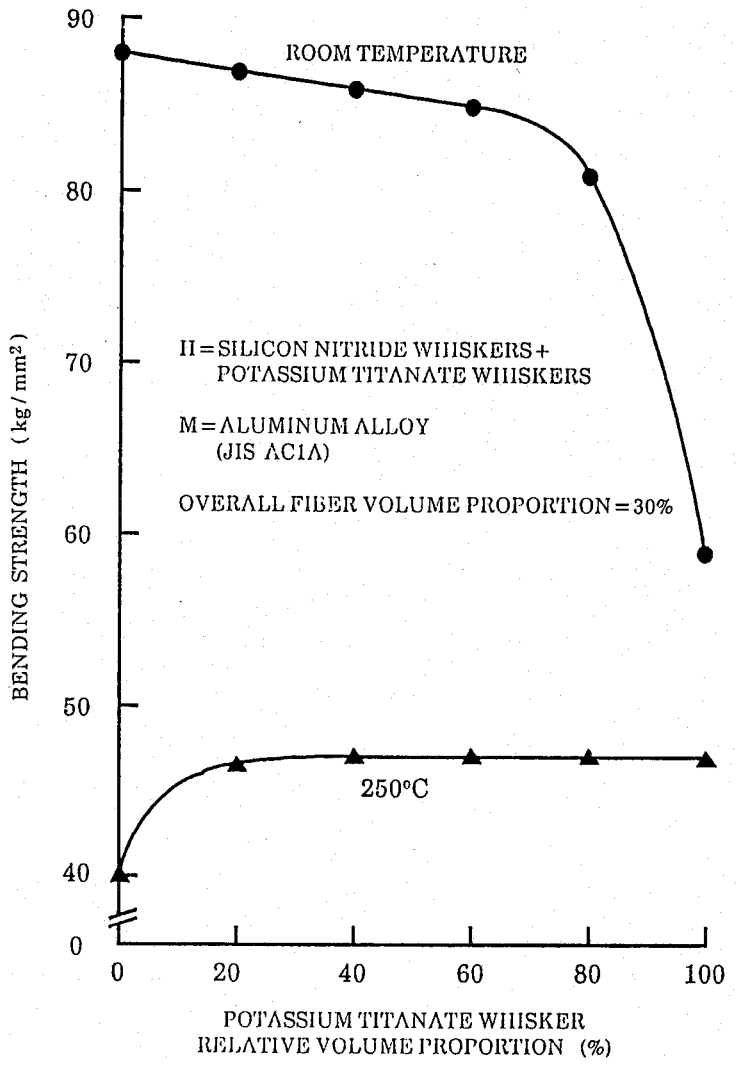
FIG. 1 is a set of two graphs in which potassium titanate whisker relative volume proportion in percent is shown along the horizontal axis and bending strength in kg/mm$^2$ is shown along the vertical axis, derived from data relating to bending strength tests for a first group of the first set of preferred embodiments of the material of the present invention, in which the matrix metal was aluminum alloy of JIS standaard AC1A, the volume proportion of reinforcing mixed hybrid fiber material was approximately 30%, and the fiber material which was admixtured to the potassium titanate whiskers to make said mixed hybrid fiber material was silicon nitride whiskers, with the short fibers in said mixed hybrid fiber material being aligned substantially randomly in three dimensions, one of said graphs showing the relation between potassium titanate whisker relative proportion and bending strength of the composite material test pieces at room temperature and the other of said graphs showing the relation between potassium titanate whisker relative volume proportion and bending strength of the composite material test pieces at a high temperature of approximately 250° C.
Figure 2:
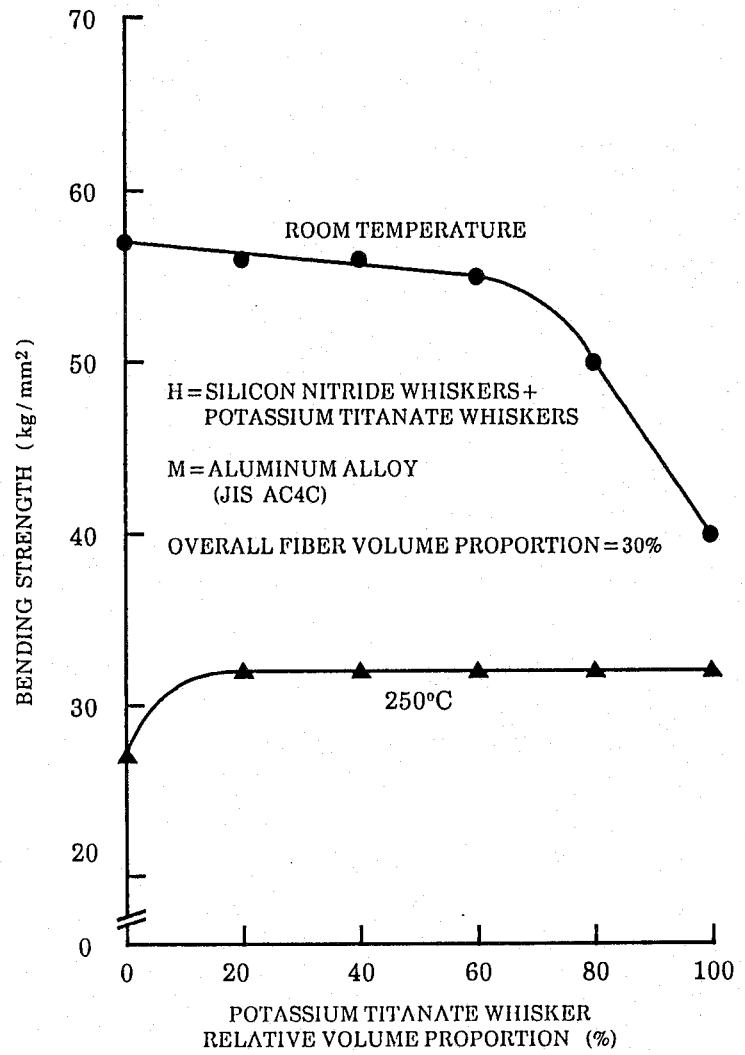
FIG. 2 is a set of two graphs in which again potassium titanate whisker relative volume proportion in percent is shown along the horizontal axis and bending strength in kg/mm$^2$ is shown along the vertical axis, similar to FIG. 1 for the first group of said first set of preferred embodiments, derived from data relating to bending strength tests for a second group of said first set of preferred embodiments of the material of the present invention, in which the matrix metal was now aluminum alloy of JIS standard AC4C, the volume proportion of reinforcing mixed hybrid fiber material was again approximately 30%, and the fiber material which was admixtured to the potassium titanate whiskers to make said mixed hybrid fiber material was again silicon nitride whiskers, with the short fibers in said mixed hybrid fiber material again being aligned substantially randomly in three dimensions, one of said graphs showing the relation between potassium titanate whisker relative volume proportion and bening strength of the composite material test pieces at room temperature and the other of said graphs showing the relation between potassium titanate whisker relative volume proportion and bending strength of the composite material test pieces at a high temperature of approximately 250° C.
Figure 3:
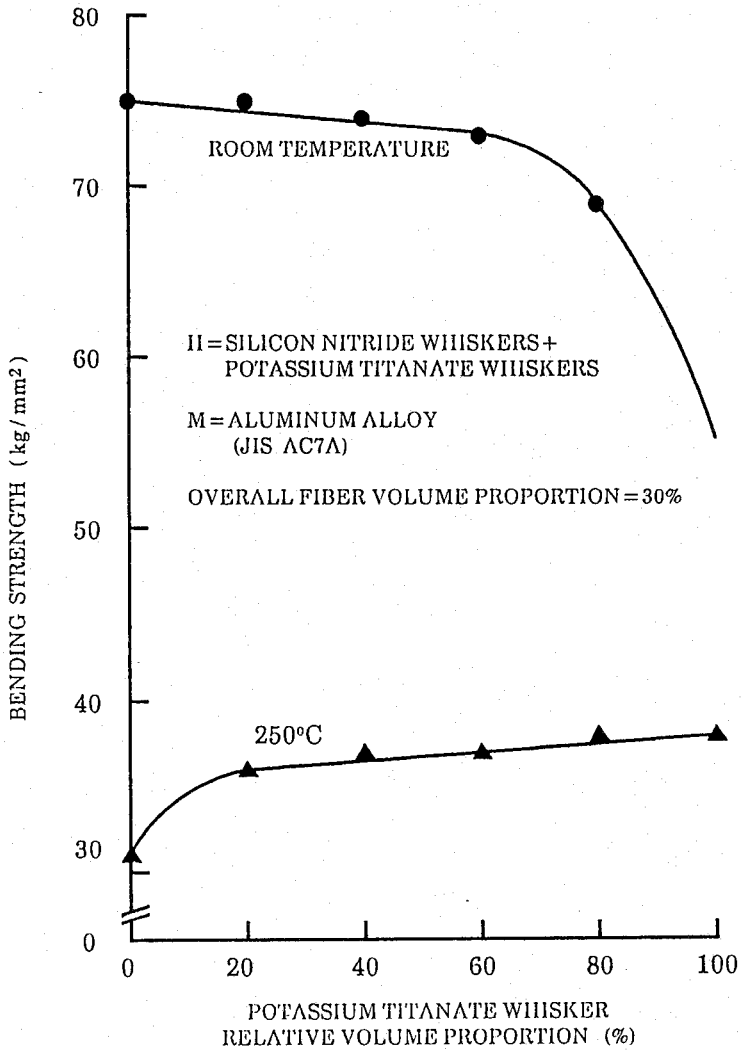
FIG. 3 is a set of two graphs in which again potassium titanate whisker relative volume proportion in percent is shown along the horizontal axis and bending strength in kg/mm$^2$ is shown along the vertical axis, similar to FIG. 1 for the first group of said first set of preferred embodiments and to FIG. 2 for the second group of said first preferred embodiment set, derived from data relating to bending strength tests for a third group of said first set of preferred embodiments of the material of the present invention, in which the matrix metal was now aluminum alloy of JIS standard AC7A, the volume proportion of reinforcing mixed hybrid fiber material was again approximately 30%, and the fiber material which was admixtured to the potassium titanate wiskers to make said mixed hybrid fiber material was again silicon nitride whiskers, with the short fibers in said mixed hybrid fiber material again being aligned substantially randomly in three dimensions, one of said graphs showing the relation between potassium titanate whisker relative volume proportion and bending strength of the composite material test pieces at room temperature and the other of said graphs showing the relation between potassium titanate whisker relative volume proportion and bending strength of the composite material test pieces at a high temperature of approximately 250° C.

The results of these bending strength tests were as shown in Part 1 of the appended Table 2, and as summarized in the line graphs of FIGS. 1 through 3, which relate to the cases of the aluminum alloy matrix metal being of the type JIS standard AC1A, being of the type JIS standard AC4C, and being of the type JIS standard AC7A, respectively. The first through the third portions of Part 1 of Table 2 show, for the respective cases of the aluminum alloy matrix metal being of the type JIS standard AC1A, being of the type JIS standard AC4C, and being of the type JIS standard AC7A, the values of the bending strength (in kg/mm$^2$) for each of the test sample pieces made from the preforms made from the mixed hybrid fiber materials designated as A1 through A6, both at room temperature and at high temperature. And each of the line graphs of FIG. 1 shows the relation between the potassium titanate whisker relative volume proportion (in percent) shown along the horizontal axis and the bending strength (in kg/mm$^2$) shown along the vertical axis of those of said composite material test pieces having as matrix metal aluminum alloy JIS standard AC1A, and having as reinforcing material the above specified mixed hybrid fiber material in volume proportion of 30%; each of the line graphs of FIG. 2 likewise shows the relation between the potassium titanate whisker relative volume proportion (in percent) shown along the horizontal axis and the bending strength (in kg/mm$^2$) shown along the vertical axis of those of said composite material test pieces having as matrix metal aluminum alloy JIS standard AC4C, and having as reinforcing material the above specified mixed hybrid fiber material in volume proportion of 30%; and each of the line graphs of FIG. 3 similarly the relation between the potassium titanate whisker relative volume proportion (in percent) shown along the horizontal axis and the bending strength (in kg/mm$^2$) shown along the vertical axis of those of said composite material test pieces having as matrix metal aluminum alloy JIS standard AC7A, and having as reinforcing material the above specified mixed hybrid fiber material in volume proportion of 30%.

From Part 1 of Table 2 and from FIGS. 1 through 3 it will be understood that for all of these composite materials, whichever aluminum alloy of the three ones detailed was used as the matrix metal, when the relative volume proportion of the potassium titanate whiskers included in the mixed hybrid reinforcing fiber material of these composite material bending strength test sample pieces was less than about 70%, and especially when said potassium titanate whisker relative volume proportion was less than about 60%, the bending strength of the composite material test sample pieces at room temperature was substantially the same as or near that of composite material test sample pieces which had as reinforcing fibers only silicon nitride whisker material; in other words, the potassium titanate whiskers did not substantially deteriorate the bending strength at room temperature of said composite material test sample pieces. On the other hand, in the range of potassium titanate whisker relative volume proportion greater than about 70%, and particularly in the range of potassium titanate whisker relative volume proportion greater than about 80%, it will further be seen that the bending strength of the composite material test sample pieces at room temperature decreased rapidly as the potassium titanate whisker relative volume proportion increased. Yet further, it will be seen that, for all of these composite materials, again whichever aluminum alloy of the three ones detailed was used as the matrix metal, when the relative volume proportion of the potassium titanate whiskers included in the mixed hybrid reinforcing fiber material of these composite material bending strength test sample pieces was from about 0% to about 20%, and especially when said potassium titanate whisker relative volume proportion was from about 0% to about 10%, the bending strength of the composite material test sample pieces at relatively high temperature was relatively low, and further increased rapidly as the potassium titanate whisker relative volume proportion increased; and, in the range where said potassium titanate whisker relative volume proportion was greater than about 10%, and particularly in the range where said potassium titanate whisker relative volume proportion was greater than about 20%, said bending strength at high temperature of said composite material test sample pieces was substantially the same as or was near that of composite material test sample pieces which had as reinforcing fibers only potassium titanate whisker material; in other words, in this high temperature case, the silicon nitride short fibers did not substantially deteriorate the bending strength of said composite material test sample pieces.

From the results of these bending strength tests it will be seen that, in order to provide for a good and appropriate bending strength both at room temperatures and at relatively high temperatures for a composite material having as its reinforcing fiber material such a hybrid short fiber mixture of silicon nitride whisker material and potassium titanate whisker material at an overall hybrid fiber volume proportion of approximately 30% and having as its matrix metal an aluminum alloy such as JIS standard AC1A or JIS standard AC4C or JIS standard AC7A or the like, it is preferable for the relative volume proportion of the potassium titanate whisker in said reinforcing hybrid fiber material to be in the range of from approximately 10% to approximately 80%, or more preferably to be in the range of from approximately 10% to approximately 70%, or even more preferably to be in the range of from approximately 20% to approximately 60%.

THE SECOND SET OF PREFERRED EMBODIMENTS (hybrid fibers-mixture of silicon nitride whiskers and potassium titanate whiskers; matrix metal-aluminum alloy; overall fiber volume proportion 10%)

Next, the present inventors manufactured eighteen further bending strength test samples of various composite materials, again utilizing as reinforcing material the same hybrid short fiber material containing silicon nitride whisker material and potassium titanate whisker material mixed together in six different relative volume proportions, and utilizing as matrix metal substantially the same three aluminum alloys of JIS standard AC1A, JIS standard AC4C, and JIS standard AC7A, but this time in each case employing an overall hybrid fiber volume proportion of approximately 10%. Then the present inventors again conducted evaluations of the bending strength of these eighteen resulting composite material sample pieces, again both at room temperature and at a high temperature of approximately 250° C.

In more detail, first a set of six quantities, denoted hereinafter as B1 through B6, of mixed hybrid fiber material were made as before by mixing together silicon nitride whisker material and potassium titanate whisker material in the respective relative volume proportions of 1:0, 4:1, 3:2, 2:3, 1:4, and 0:1, i.e. so that the potassium titanate whisker relative volume proportion therein was, as before, respectively 0%, 20%, 40%, 60%, 80%, and 100%. The composition of each of these six quantities B1 through B6 of mixed hybrid fiber material is further shown in Table 1. Then, from each of these six mixed hybrid fiber material quantities B1 through B6, there were formed three preforms by, in each case, subjecting a quantity of the relevant mixed hybrid fiber material to compression forming; thus, in all, there were eighteen such preforms, as in the first set of preferred embodiments described above, and of substantially the same dimensions. However, in this case, the overall mixed hybrid fiber material volume proportion in each of said preforms, in this second set of preferred embodiments of the composite material of the present invention, was only approximately 10%. Next, substantially as before, each of these mixed hybrid short fiber material preforms was subjected to high pressure casting together with an appropriate quantity of one of the aluminum alloys JIS standard AC1A or JIS standard AC4C or JIS standard AC7A described above, utilizing in each case operational parameters substantially as before; and in each case the resulting solidified aluminum alloy mass with its preform included in it was removed from the casting mold, and was machined to leave a sample piece of composite material which had a mixture of silicon nitride whisker material and potassium titanate whisker material as reinforcing material and the appropriate one of the aluminum alloys JIS standard AC1A or JIS standard AC4C or JIS standard AC7A as matrix metal. And post processing steps were performed on these composite material samples, substantially as before. The overall volume proportion of the hybrid short fiber material in each of these bending strength test sample pieces was thus now approximately 10%. From each of the composite material sample pieces manufactured as described above, to which heat treatment had been applied, there was cut a bending strength test piece of dimensions and parameters substantially as in the case of the first set of preferred embodiments described above, and for each of these composite material bending strength test pieces a bending strength test was carried out under substantially the same conditions and in substantially the same manner as before, i.e. twice: once with the temperature of the composite material bending strength test pieces being room temperature and once with the temperature of said composite material bending strength test pieces being approximately 250° C.

Figure 4:
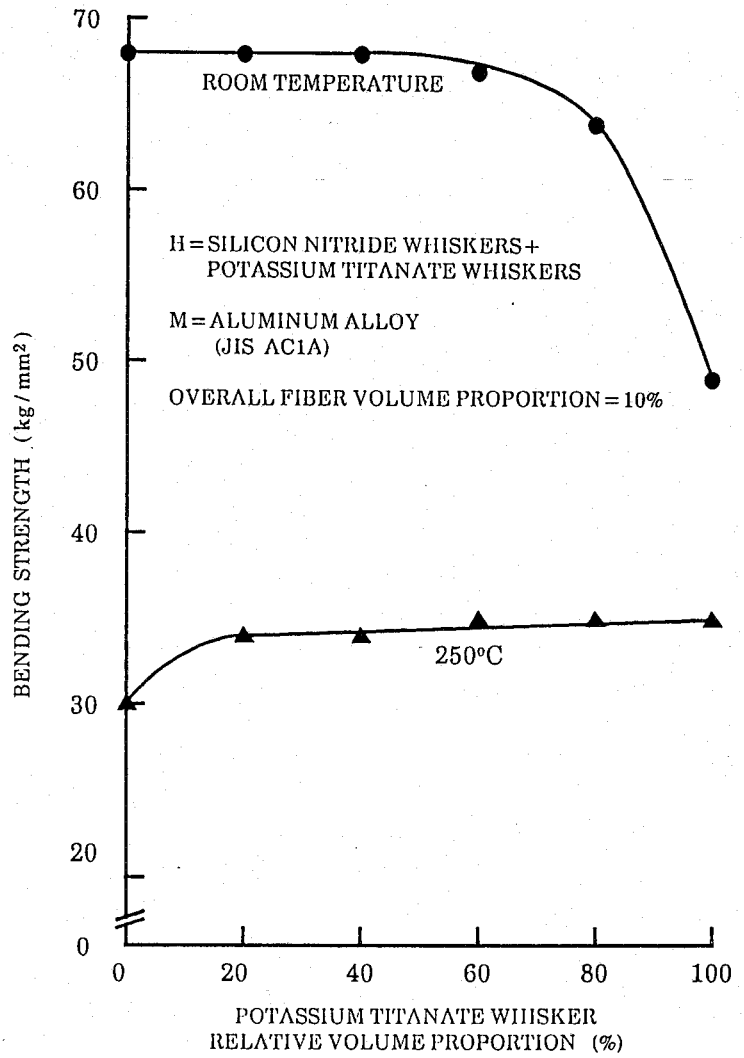
FIG. 4 is a set of two graphs in which again potassium titanate whisker relative volume proportion in percent is shown along the horizontal axis and bending strength in kg/mm$^2$ is shown along the vertical axis, similar to FIG. 1 for the first group of the first set of preferred embodiments, derived from data relating to bending strength tests for a first group of the second set of preferred embodiments of the material of the present invention, in which the matrix metal was aluminum alloy of JIS standard AC1A, the volume proportion of reinforcing mixed hybrid fiber material was now approximately 10%, and the fiber material which was admixtured to the potassium titanate whiskers to make said mixed hybrid fiber material was again silicon nitride whiskers, with the short fibers in said mixed hybrid fiber material again being aligned substantially randomly in three dimensions, one of said graphs showing the relation between potassium titanate whisker relative volume proportion and bending strength of the composite material test pieces at room temperature and the other of said graphs showing the relation between potassium titanate whisker relative volume proportion and bending strength of the composite material test pieces at a high temperature of approximately 250° C.
Figure 5:
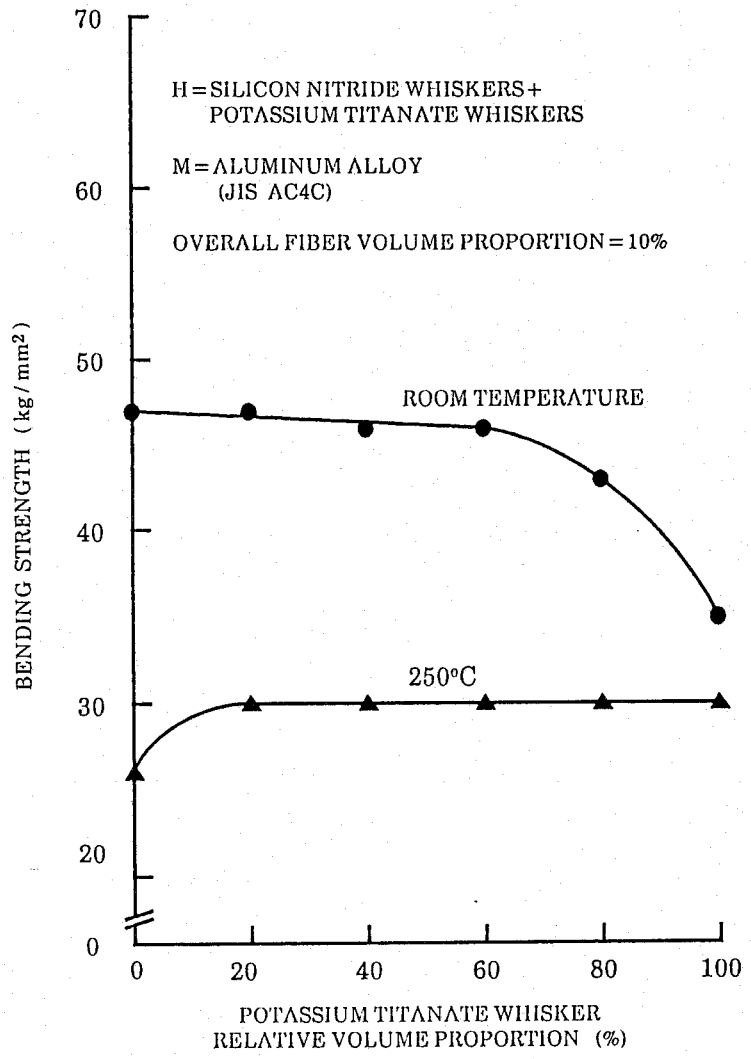
FIG. 5 is a set of two graphs in which again potassium titanate whisker relative volume proportion in percent is shown along the horizontal axis and bending strength in kg/mm$^2$ is shown along the vertical axis, similar to FIG. 4 for the first group of the second set of preferred embodiments, derived from data relating to bending strength tests for a second group of said second set of preferred embodiments of the material of the present invention, in which the matrix metal was now aluminum alloy of JIS standard AC4C, the volume proportion of reinforcing mixed hybrid fiber material was again approximately 10%, and the fiber material which was admixtured to the potassium titanate whiskers to make said mixed hybrid fiber material was again silicon nitride whiskers, with the short fibers in said mixed hybrid fiber material again being aligned substantially randomly in three dimensions, one of said graphs showing the relation between potassium titanate whisker relative volume proportion and bending strength of the composite material test pieces at room temperature and the other of said graphs showing the relation between potassium titanate whisker relative volume proportion and bending strength of the composite material test pieces at a high temperature of approximately 250° C.
Figure 6:
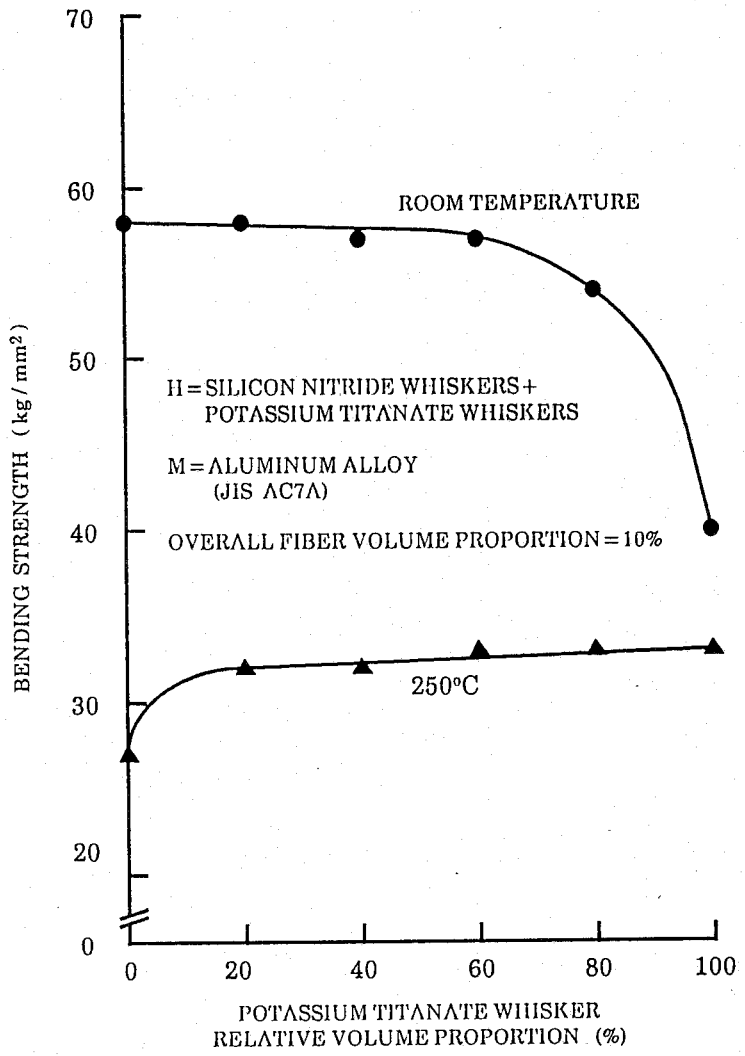
FIG. 6 is a set of two graphs in which again potassium titanate whisker relative volume proportion in percent is shown along the horizontal axis and bending strength in kg/mm$^2$ is shown along the vertical axis, similar to FIG. 4 for the first group of this second set of preferred embodiments and to FIG. 5 for the second group of said second preferred embodiment set, derived from data relating to bending strength tests for a third group of said second set of preferred embodiments of the material of the present invention, in which the matrix metal was now aluminum alloy of JIS standard AC7A, the volume proportion of reinforcing mixed hybrid fiber material was again approximately 10%, and the fiber material which was admixtured to the potassium titanate whiskers to make said mixed hybrid fiber material was again silicon nitride whiskers, with the short fibers in said mixed hybrid fiber material again being aligned substantially randomly in three dimensions, one of said graphs showing the relation between potassium titanate whisker relative volume proportion and bending strength of the composite material test pieces at room temperature and the other of said graphs showing the relation between potassium titanate whisker relative volume proportion and bending strength of the composite material test pieces at a high temperature of approximately 250° C.

The results of these bending strength tests were as shown in Part 2 of the appended Table 2, and as summarized in the line graphs of FIGS. 4 through 6, which relate to the cases of the aluminum alloy matrix metal being of the type JIS standard AC1A, being of the type JIS standard AC4C, and being of the type JIS standard AC7A, respectively. The first through the third portions of Part 2 of Table 2 show, for the respective cases of the aluminum alloy matrix metal being of the type JIS standard AC1A, being of the type JIS standard AC4C, and being of the type JIS standard AC7A, the values of the bending strength (in kg/mm$^2$) for each of the test sample pieces made from the preforms made from the mixed hybrid fiber materials designated as B1 through B6, both at room temperature and at high temperature. And each of the line graphs of FIG. 4 shows the relation between the potassium titanate whisker relative volume proportion (in percent) shown along the horizontal axis and the bending strength (in kg/mm$^2$) shown along the vertical axis of those of said composite material test pieces having as matrix metal aluminum alloy JIS standard AC1A, and having as reinforcing material the above specified mixed hybrid fiber material in volume proportion of 10%; each of the line graphs of FIG. 5 likewise shows the relation between the potassium titanate whisker relative volume proportion (in percent) shown along the horizontal axis and the bending strength (in kg/mm$^2$) shown along the vertical axis of those of said composite material test pieces having as matrix metal aluminum alloy JIS standard AC4C, and having as reinforcing material the above specified mixed hybrid fiber material in volume proportion of 10%; and each of the line graphs of FIG. 6 similarly the relation between the potassium titanate whisker relative volume proportion (in percent) shown along the horizontal axis and the bending strength (in kg/mm$^2$) shown along the vertical axis of those of said composite material test pieces having as matrix metal aluminum alloy JIS standard AC7A, and having as reinforcing material the above specified mixed hybrid fiber material in volume proportion of 10%.

From Part 2 of Table 2 and from FIGS. 4 through 6 it will be understood that for all of these composite materials, whichever aluminum alloy of the three ones detailed was used as the matrix metal, when the relative volume proportion of the potassium titanate whiskers included in the mixed hybrid reinforcing fiber material of these composite material bending strength test sample pieces was less than about 70%, and especially when said potassium titanate whisker relative volume proportion was less than about 60%, the bending strength of the composite material test sample pieces at room temperature was substantially the same as or near that of composite material test sample pieces which had as reinforcing fibers only silicon nitride whisker material; in other words, the potassium titanate whiskers did not substantially deteriorate the bending strength at room temperature of said composite material test sample pieces. On the other hand, in the range of potassium titanate whisker relative volume proportion greater than about 70%, and particularly in the range of potassium titanate whisker relative volume proportion greater than about 80%, it will further be seen that the bending strength of the composite material test sample pieces at room temperature decreased rapidly as the potassium titanate whisker relative volume proportion increased. Yet further, it will be seen that, for all of these composite materials, again whichever aluminum alloy of the three ones detailed was used as the matrix metal, when the relative volume proportion of the potassium titanate whiskers included in the mixed hybrid reinforcing fiber material of these composite material bending strength test sample pieces was from about 0% to about 20%, and especially when said potassium titanate whisker relative volume proportion was from about 0% to about 10%, the bending strength of the composite material test sample pieces at relatively high temperature was relatively low, and further increased rapidly as the potassium titanate whisker relative volume proportion increased; and, in the range where said potassium titanate whisker relative volume proportion was greater than about 10%, and particularly in the range where said potassium titanate whisker relative volume proportion was greater than about 20%, said bending strength at high temperature of said composite material test sample pieces was substantially the same as or was near that of composite material test sample pieces which had as reinforcing fibers only potassium titanate whisker material; in other words, in this high temperature case, the silicon nitride short fibers did not substantially deteriorate the bending strength of said composite material test sample pieces.

From the results of these bending strength tests it will be seen that, in order to provide for a good and appropriate bending strength both at room temperatures and at relatively high temperatures for a composite material having as its reinforcing fiber material such a hybrid short fiber mixture of silicon nitride whisker material and potassium titanate whiskers at an overall hybrid fiber volume proportion now of approximately 10% and having as its matrix metal an aluminum alloy such as JIS standard AC1A or JIS standard AC4C or JIS standard AC7A or the like, it is preferable for the relative volume proportion of the potassium titanate whiskers in said reinforcing hybrid fiber material to be in the range of from approximately 10% to approximately 80%, or more preferably to be in the range of from approximately 10% to approximately 70%, or even more preferably to be in the range of from approximately 20% to approximately 60%.

THE THIRD SET OF PREFERRED EMBODIMENTS (hybrid fibers-mixture of silicon carbide whiskers and potassium titanate whiskers; matrix metal-magnesium alloy; overall fiber volume proportion 30%)

Next, the present inventors manufactured six further bending strength test samples of various composite materials, now utilizing as reinforcing material a hybrid short fiber material containing potassium titante whisker material and, this time, silicon carbide whisker material, mixed together in six different relative volume proportions, and utilizing as matrix metal a magnesium alloy of JIS standard MC2, and this time employing an overall hybrid fiber volume proportion of approximately 30%. Then the present inventors again conducted evaluations of the bending strength of these six resulting composite material sample pieces, again both at room temperature and at a high temperature of approximately 250° C.

In more detail, first a set of six quantities, denoted hereinafter as C1 through C6, of mixed hybrid fiber material were made by mixing together silicon carbide whisker material and potassium titanate whisker material in the respective relative volume proportions of 1:0, 4:1, 3:2, 2:3, 1:4, and 0:1, i.e. so that the potassium titanate whisker relative volume proportion therein was, as before, respectively 0%, 20%, 40%, 60%, 80%, and 100%. The silicon carbide whiskers were of a type which was manufactured by Tokai Carbon K.K. and had average fiber length of from about 50 microns to about 200 microns and average fiber diameter from about 0.2 micron to about 5 microns, and the potassium titanate whisker material was substantially the same as that used in the first and the second sets of preferred embodiments detailed above. The composition of each of these six quantities C1 through C6 of mixed hybrid fiber material is further shown in Table 1. Then, from each of these six mixed hybrid fiber material quantities C1 through C6, there was formed a preform by, in each case, subjecting a quantity of the relevant mixed hybrid fiber material to compression forming; thus, in all, there were six such preforms, each like the preforms of the first set of preferred embodiments described above, and of substantially the same dimensions. In this case, the overall mixed hybrid fiber material volume proportion in each of said preforms, in this third set of preferred embodiments of the composite material of the present invention, was approximately 30%. Next, substantially as before, each of these mixed hybrid short fiber material preforms was subjected to high pressure casting together with an appropriate quantity of the magnesium alloy JIS standard MC2 described above, utilizing in each case operational parameters substantially as before, except that the temperature of the molten magnesium alloy was 690° C., and the heat treatments applied to the composite material sample pieces were solution treatment at a temperature of 410° C. for approximately 16 hours and artificial aging processing at a temperature 215° C. of for approximately 4 hours; and in each case the resulting solidified magnesium alloy mass with its preform included in it was removed from the casting mold, and was machined to leave a sample piece of composite material which had a mixture of silicon carbide whisker material and potassium titanate whisker material as reinforcing material and the magnesium alloy JIS standard MC2 as matrix metal. The overall volume proportion of the hybrid short fiber material in each of these bending strength test sample pieces was thus approximately 30%. From each of the composite material sample pieces manufactured as described above, to which heat treatment had been applied, there was cut a bending strength test piece of dimensions and parameters substantially as in the case of the first and second sets of preferred embodiments described above, and for each of these composite material bending strength test pieces a bending strength test was carried out under substantially the same conditions and in substantially the same manner as before, i.e. twice: once with the temperature of the composite material bending strength test pieces being room temperature and once with the temperature of said composite material bending strength test pieces being approximately 250° C.

Figure 7:
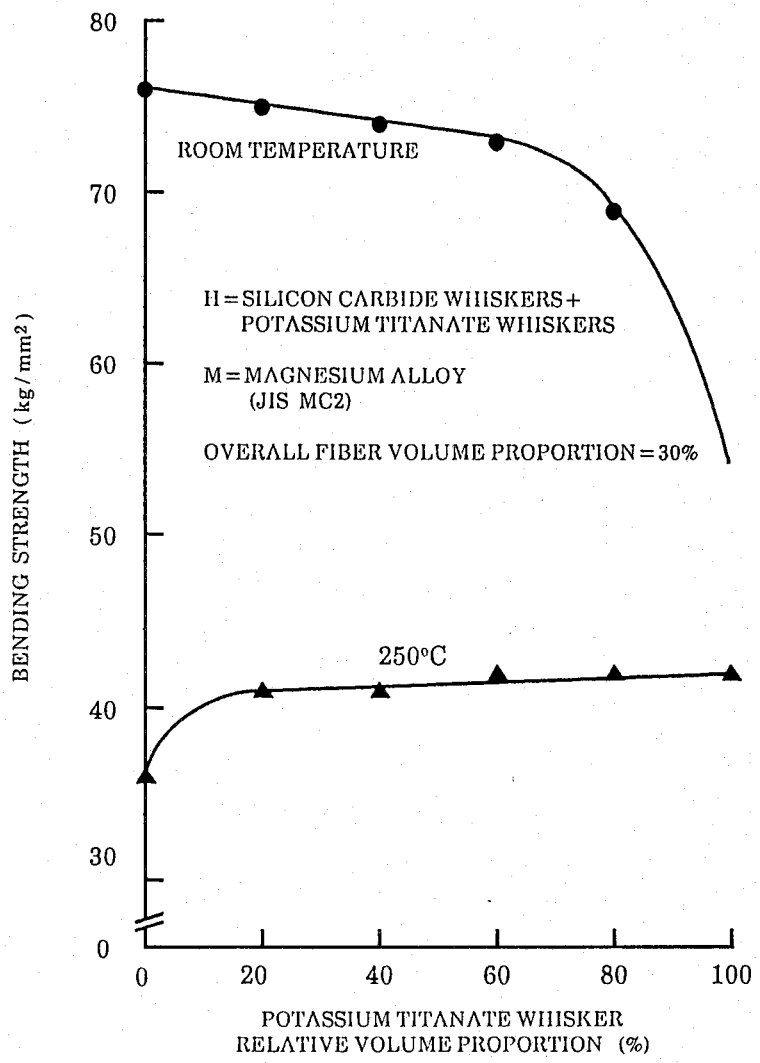
FIG. 7 is a set of two graphs in which again potassium titanate whisker relative volume proportion in percent is shown along the horizontal axis and bending strength in kg/mm$^2$ is shown along the vertical axis, similar to FIG. 1 for the first group of the first set of preferred embodiments, derived from data relating to bending strength tests for the third set of preferred embodiments of the material of the present invention, in which the matrix metal was now magnesium alloy of JIS standard MC2, the volume proportion of reinforcing mixed hybrid fiber material was now approximately 30%, and the fiber material which was admixtured to the potassium titanate whiskers to make said mixed hybrid fiber material was now silicon carbide whiskers, with the short fibers in said mixed hybrid fiber material again being aligned substantially randomly in three dimensions, one of said graphs showing the relation between potassium titanate whisker relative volume proportion and bending strength of the composite material test pieces at room temperature and the other of said graphs showing the relation between potassium titanate whisker relative volume proportion and bending strength of the composite material test pieces at a high temperature of approximately 250° C.

The results of these bending strength tests were as shown in Part 3 of the appended Table 2, and as summarized in the line graphs of FIG. 7. Part 2 of Table 2 shows the values of the bending strength (in kg/mm$^2$) for each of the test sample pieces made from the preforms made from the mixed hybrid fiber materials designated as C1 through C6, both at room temperature and at high temperature. And each of the line graphs of FIG. 7 shows the relation between the potassium titanate whisker relative volume proportion (in percent) shown along the horizontal axis and the bending strength (in kg/mm$^2$) shown along the vertical axis of certain of these composite material test pieces having as matrix metal magnesium alloy JIS standard MC2 and having as reinforcing material the above specified mixed hybrid fiber material in volume proportion of 30%.

From Part 3 of Table 2 and from FIG. 7 it will be understood that, for these composite materials, when the relative volume proportion of the potassium titanate whisker included in the mixed hybrid reinforcing fiber material of these composite material bending strength test sample pieces was less than about 70%, and especially when said potassium titanate whisker relative volume proportion was less than about 60%, the bending strength of the composite material test sample pieces at room temperature was substantially the same as or near that of composite material test sample pieces which had as reinforcing fibers only silicon carbide whisker material; in other words, the potassium titanate whiskers did not substantially deteriorate the bending strength at room temperature of said composite material test sample pieces. On the other hand, in the range of potassium titanate whisker relative volume proportion greater than about 70%, and particularly in the range of potassium titanate whisker relative volume proportion greater than about 80%, it will further be seen that the bending strength of the composite material test sample pieces at room temperature decreased rapidly as the potassium titanate whisker relative volume proportion increased. Yet further, it will be seen that, for these composite materials, when the relative volume proportion of the potassium titanate whisker included in the mixed hybrid reinforcing fiber material of these composite material bending strength test sample pieces was from about 0% to about 20%, and especially when said potassium titanate whisker relative volume proportion was from about 0% to about 10%, the bending strength of the composite material test sample pieces at relatively high temperature was relatively low, and further increased rapidly as the potassium titanate whisker relative volume proportion increased; and, in the range where said potassium titanate whisker relative volume proportion was greater than about 10%, and particularly in the range where said potassium titanate whisker relative volume proportions was greater than about 20%, said bending strength at high temperature of said composite material test sample pieces was substantially the same as or was near that of composite material test sample pieces which had as reinforcing fiber material only potassium titanate whisker material; in other words, in this high temperature case, the silicon carbide short fibers did not substantially deteriorate the bending strength of said composite material test sample pieces.

From the results of these bending strength tests it will be seen that, in order to provide for a good and appropriate bending strength both at room temperatures and at relatively high temperatures for a composite material having as its reinforcing fiber material such a hybrid short fiber mixture of silicon carbide whisker material and potassium titanate whiskers at an overall hybrid fiber volume proportion of approximately 30% and having as its matrix metal a magnesium alloy such as JIS standard MC2 or the like, it is preferable for the relative volume proportion of the potassium titanate whiskers in said reinforcing hybrid fiber material to be in the range of from approximately 10% to approximately 80%, or more preferably to be in the range of from approximately 10% to approximately 70%, or even more preferably to be in the range of from approximately 20% to approximately 60%.

THE FOURTH SET OF PREFERRED EMBODIMENTS (hybrid fibers-mixture of crystalline alumina-silica short fibers and potassium titanate whiskers; matrix metal-aluminum alloy; overall fiber volume proportion 10%)

Next, the present inventors manufactured eighteen further bending strength test samples of various composite materials, now utilizing as reinforcing material a hybrid short fiber material containing crystalline alumina-silica short fiber material and potassium titanate whisker material mixed together in six different relative volume proportions, and utilizing as matrix metal substantially the same three aluminum alloys of JIS standard AC1A, JIS standard AC4C, and JIS standard AC7A as utilized in the first and the second sets of preferred embodiments detailed above, this time in each case employing an overall hybrid fiber volume proportion of approximately 30%. Then the present inventors again conducted evaluations of the bending strength of these eighteen resulting composite material sample pieces, again both at room temperature and at a high temperature of approximately 250° C.

Figure 21:
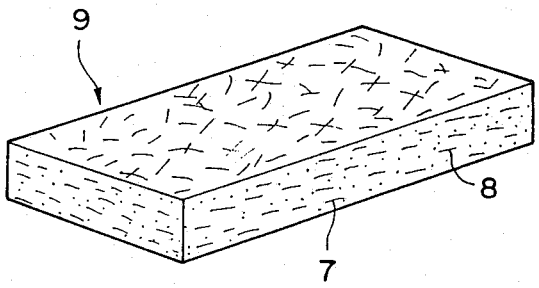
FIG. 21 is similar to FIG. 18, being a perspective view of a preform made of mixed hybrid type short fiber material, with said hybrid short fibers being aligned substantially randomly in two dimensions and being layered in the third dimension perpendicular to said two dimensions, for incorporation into composite materials according to various preferred embodiments of the present invention.

In more detail, first a set of six quantities, denoted hereinafter as D1 through D6, of mixed hybrid fiber material were made as before by mixing together crystalline alumina-silica short fiber material and potassium titanate whisker material in the respective relative volume proportions of 1:0, 4:1, 3:2, 2:3, 1:4, and 0:1, i.e. so that the potassium titanate whisker relative volume proportion therein was, as before, respectively 0%, 20%, 40%, 60%, 80%, and 100%. The crystalline alumina-silica short fibers were of a type consisting of approximately 55% by weight of $Al_2O_3$ and balance substantially $SiO_2$ and which had average fiber length of about 1 mm and average fiber diameter of about 3 microns, and the potassium titanate whisker material was substantially the same as that used in the first through the third sets of preferred embodiments detailed above. The composition of each of these six quantities D1 through D6 of mixed hybrid fiber material is further shown in Table 1. Then, from each of these six mixed hybrid fiber material quantities D1 through D6, there were formed three preforms by, in each case, subjecting a quantity of the relevant mixed hybrid fiber material to compression forming; thus, in all, there were eighteen such preforms, as in the first and the second sets of preferred embodiments described above, and of substantially the same dimensions as in the previous embodiments. In this case, the overall mixed hybrid fiber material volume proportion in each of said preforms, in this fourth set of preferred embodiments of the composite material of the present invention, was approximately 30%. However, in this fourth set of preferred embodiments, the short fibers which made up these preforms were, as schematically illustrated in FIG. 21 which shows one of said preforms in perspective view as did FIG. 18 for the preforms of the first through the third sets of preferred embodiments, aligned in layers substantially parallel to the 100×38 mm faces of the preforms, i.e. were oriented substantially randomly in two dimensions and were layered in the third dimension perpendicular to said two dimensions. Next, substantially as in the case of the first and second sets of preferred embodiments described above, each of these mixed hybrid short fiber material preforms was subjected to high pressure casting together with an appropriate quantity of one of the aluminum alloys JIS standard AC1A or JIS standard AC4C or JIS standard AC7A describe above, utilizing in each case operational parameters substantially as in the case of said first and second preferred embodiment sets; and in each case the resulting solidified aluminum alloy mass with its preform included in it was removed from the casting mold, and was machined to leave a sample piece of composite material which had a mixture of crystalline alumina-silica short fiber material and potassium titanate whisker material as reinforcing material and the appropriate one of the aluminum alloys JIS standard AC1A or JIS standard AC4C or JIS standard AC7A as matrix metal. And post processing steps were performed on these composite material samples, substantially as in the case of the first and second preferred embodiment sets. Thus, the overall volume proportion of the hybrid short fiber material in each of these bending strength test sample pieces was now approximately 30%. From each of the composite material sample pieces manufactured as described above, to which heat treatment had been applied, there was cut a bending strength test piece of dimensions and parameters substantially as in the case of the previous sets of preferred embodiments described above, except that, particularly, the 50×100 mm sides of each of these bending strength test piece were cut as being oriented parallel to the planes in which the reinforcing fibers of the original preform had been randomly oriented in two dimensions; and for each of these composite material bending strength test pieces a bending strength test was carried out under substantially the same conditions and in substantially the same manner as before, i.e. twice: once with the temperature of the composite material bending strength test pieces being room temperature and once with the temperature of said composite material bending strength test pieces being approximately 250° C.

Figure 8:
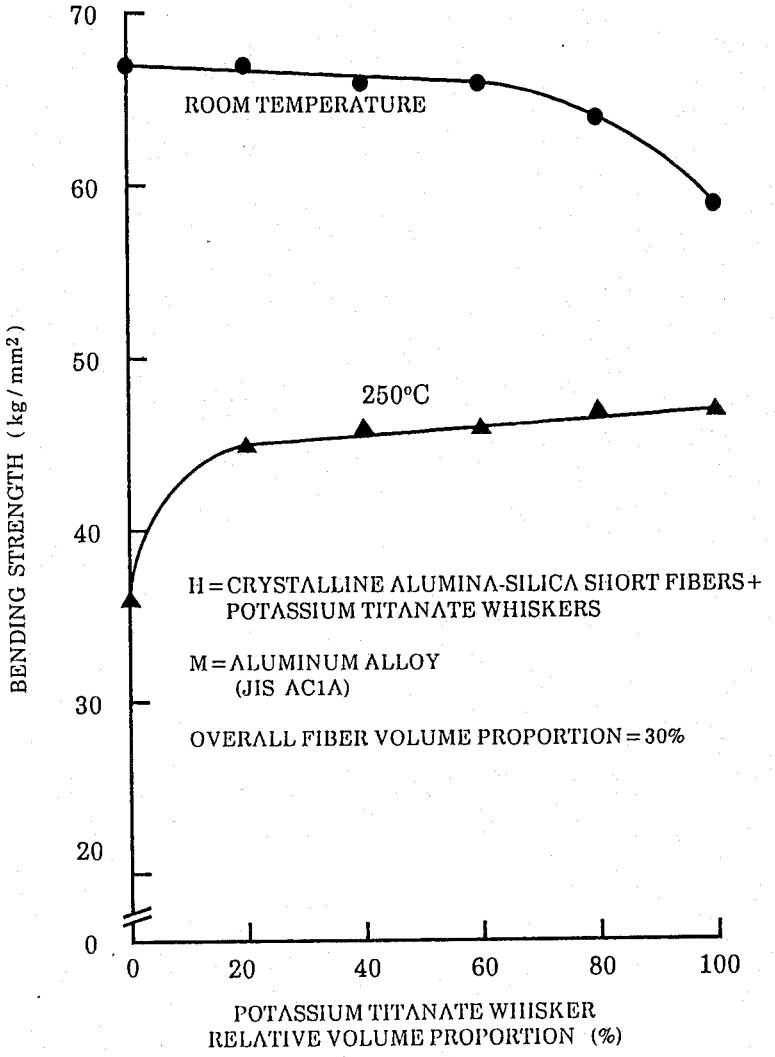
FIG. 8 is a set of two graphs in which again potassium titanate whisker relative volume proportion in percent is shown along the horizontal axis and bending strength in kg/mm$^2$ is shown along the vertical axis, similar to FIG. 1 for the first group of the first set of preferred embodiments, derived from data relating to bending strength tests for a first group of the fourth set of preferred embodiments of the material of the present invention, in which the matrix metal was now aluminum alloy of JIS standard AC1A, the volume proportion of reinforcing mixed hybrid fiber material was again approximately 30%, and the fiber material which was admixtured to the potassium titanate whiskers to make said mixed hybrid fiber material was now crystalline alumina-silica fiber material, with the hybrid fibers incorporated in said mixed hybrid fiber material now being aligned substantially randomly in two dimensions while being layered in the third dimension perpendicular to said two dimensions, one of said graphs showing the relation between potassium titanate whisker relative volume proportion and bending strength of the composite material test pieces at room temperature and the other of said graphs showing the relation between potassium titanate whisker relative volume proportion and bending strength of the composite material test pieces at a high temperature of approximately 250° C.
Figure 9:
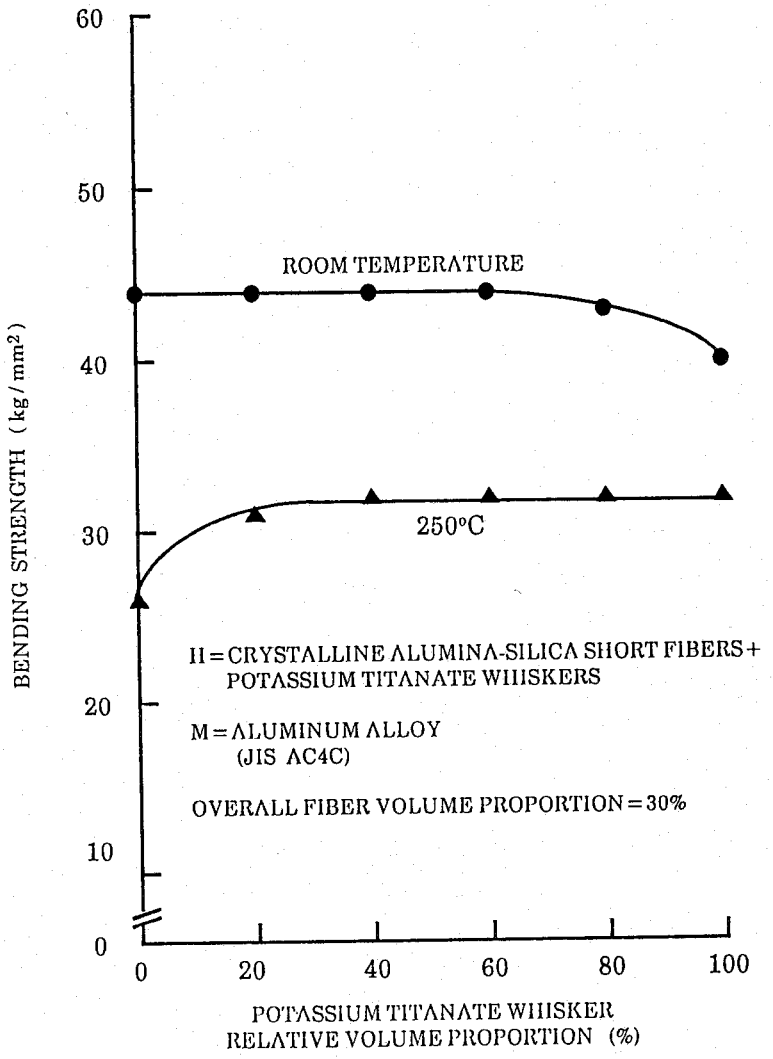
FIG. 9 is a set of two graphs in which again potassium titanate whisker relative volume proportion in percent is shown along the horizontal axis and bending strength in kg/mm$^2$ is shown along the vertical axis, similar to FIG. 8 for the first group of this fourth set of preferred embodiments, derived from data relating to bending strength tests for a second group of said fourth set of preferred embodiments of the material of the present invention, in which the matrix metal was now aluminum alloy of JIS standard AC4C, the volume proportion of reinforcing mixed hybrid fiber material was again approximately 30%, and the fiber material which was admixtured in the potassium titanate whiskers to make said mixed hybrid fiber material was again crystalline alumina-silica fiber material, with the hybrid fibers incorporated in said mixed hybrid fiber material again being aligned substantially randomly in two dimensions while being layered in the third dimension perpendicular to said two dimensions, one of said graphs showing the relation between potassium titanate whisker relative volume proportion and bending strength of the composite material test pieces at room temperature and the other of said graphs showing the relation between potassium titanate whisker relative volume proportion and bending strength of the composite material test pieces at a high temperature of approximately 250° C.
Figure 10:
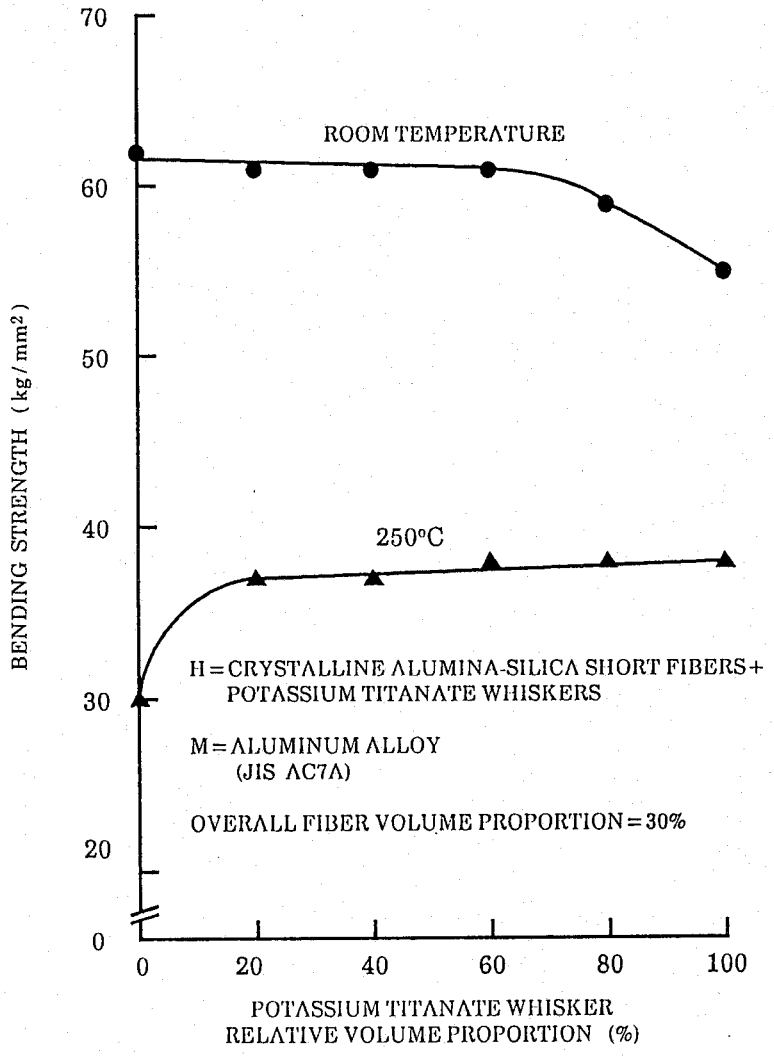
FIG. 10 is a set of two graphs in which again potassium titanate whisker relative volume proportion in percent is shown along the horizontal axis and bending strength in kg/mm$^2$ is shown along the vertical axis, similar to FIG. 8 for the first group of this fourth set of preferred embodiments and to FIG. 9 for the second group of said fourth preferred embodiment set, derived from data relating to bending strength tests for a third group of said fourth set of preferred embodiments of the material of the present invention, in which the matrix metal was now aluminum alloy of JIS standard AC7A, the volume proportion of reinforcing mixed hybrid fiber material was again approximately 30%, and the fiber material which was admixtured to the potassium titanate whiskers to make said mixed hybrid fiber material was again crystalline alumina-silica fiber material, with the hybrid fibers incorporated in said mixed hybrid fiber material again being aligned substantially randomly in two dimensions while being layered in the third dimension perpendicular to said two dimensions, one of said graphs showing the relation between potassium titanate whisker relative volume proportion and bending strength of the composite material test pieces at room temperature and the other of said graphs showing the relation between potassium titanate whisker relative volume proportion and bending strength of the composite material test pieces at a high temperature of approximately 250° C.

The results of these bending strength tests were as shown in Part 4 of the appended Table 2, and as summarized in the line graphs of FIGS. 8 through 10, which relate to the cases of the aluminum alloy matrix metal being of the type JIS standard AC1A, being the type JIS standard AC4C, and being of the type JIS standard AC7A, respectively. The first through the third portions of Part 4 of Table 2 show, for the respective cases of the aluminum alloy matrix metal being of the type JIS standard AC1A, being of the type JIS standard AC4C, and being of the type JIS standard AC7A, the values of the bending strength (in kg/mm$^2$) for each of the test sample pieces made from the preforms made from the mixed hybrid fiber materials designated as D1 through D6, both at room temperature and at high temperature. And each of the line graphs of FIG. 8 shows the relation between the potassium titanate whisker relative volume proportion (in percent) shown along the horizontal axis and the bending strength (in kg/mm$^2$) shown along the vertical axis of those of said composite material test pieces having as matrix metal aluminum alloy JIS standard AC1A, and having as reinforcing material the above specified mixed hybrid fiber material in volume proportion of 30%; each of the line graphs of FIG. 9 likewise shows the relation between the potassium titanate whisker relative volume proportion (in percent) shown along the horizontal axis and the bending strength (in kg/mm$^2$) shown along the vertical axis of those of said composite material test pieces having an matrix metal aluminum alloy JIS standard AC4C, and having as reinforcing material the above specified mixed hybrid fiber material in volume proportion of 30%; and each of the line graphs of FIG. 10 similarly the relation between the potassium titanium whisker relative volume proportion (in percent) shown along the horizontal axis and the bending strength (in kg/mm$^2$) shown along the vertical axis of those of said composite material test pieces having as matrix metal aluminum alloy JIS standard AC7A, and having as reinforcing material the above specified mixed hybrid fiber material in volume proportion of 30%.

From Part 4 of Table 2 and from FIGS. 8 through 10 it will be understood that for all of these composite materials, whichever aluminum alloy of the three ones detailed was used as the matrix metal, when the relative volume proportion of the potassium titanate whiskers included in the mixed hybrid reinforcing fiber material of these composite material bending strength test sample pieces was less than about 70%, and especially when said potassium titanate whisker relative volume proportion was less than about 60%, the bending strength of the composite material test sample pieces at room temperature was substantially the same as or near that of composite material test sample pieces which had as reinforcing fibers only crystalline alumina-silica short fiber material; in order words, the potassium titanate whiskers did not substantially deteriorate the bending strength at room temperature of said composite material test sample pieces. On the other hand, in the range of potassium titanate whisker relative volume proportion greater than about 70%, and particular in the range of potassium titanate whisker relative volume proportion greater than about 80%, it will further be seen that the bending strength of the composite material test sample pieces at room temperature decreased rapidly as the potassium titanate whisker relative volume proportion increased. Yet further, it will be seen that, for all of these composite materials, again whichever aluminum alloy of the three ones detailed was used as the matrix metal, when the relative volume proportion of the potassium titanate whiskers included in the mixed hybrid reinforcing fiber material of these composite material bending strength test sample pieces was from about 0% to about 20%, and especially when said potassium titanate whisker relative volume proportion was from about 0% to about 10%, the bending strength of the composite material test sample pieces at relatively high temperature was relatively low, and further increased rapidly as the potassium titanate whisker relative volume proportion increased; and, in the range where said potassium titanate whisker relative volume proportion was greater than about 10%, and particularly in the range where said potassium titanate whisker relative volume proportion was greater than about 20%, said bending strength at high temperature of said composite material test sample pieces was substantially the same as or was near that of composite material test sample pieces which had as reinforcing fibers only potassium titanate whisker material; in other words, in this high temperature case, the crystalline alumina-silica short fibers did not substantially deteriorate the bending strength of said composite material test sample pieces.

From the results of these bending strength tests it will be seen that, in order to provide for a good and appropriate bending strength both at room temperatures and at relatively high temperatures for a composite material having as its reinforcing fiber material such as hybrid short fiber mixture of crystalline alumina-silica short fiber material and potassium titanate whiskers at an overall hybrid fiber volume proportion of approximately 30% and having as its matrix metal an aluminum alloy such as JIS standard AC1A or JIS standard AC4C or JIS standard AC7A or the like, it is preferable for the relative volume proportion of the potassium titanate whiskers in said reinforcing hybrid fiber material to be in the range of from approximately 10% to approximately 80%, or more preferably to be in the range of from approximately 10% to approximately 70%, or even more preferably to be in the range of from approximately 20% to approximately 60%.

THE FIFTH SET OF PREFERRED EMBODIMENTS (hybrid fibers-mixture of crystalline alumina-silica short fibers and potassium titanate whiskers; matrix metal-aluminum alloy; overall fiber volume proportion 10%)

Next, the present inventors manufactured eighteen further bending strength test samples of various composite materials, again utilizing as reinforcing material the same hybrid short fiber material as used in the fourth set of preferred embodiments containing crystalline alumina-silica short fiber material and potassium titanate whisker material mixed together in six different relative volume proportions, and utilizing as matrix metal substantially the same three aluminum alloys of JIS standard AC1A, JIS standard AC4C, and JIS standard AC7A, but this time in each case employing an overall hybrid fiber volume proportion of approximately 10%. Then the present inventors again conducted evaluations of the bdnding strength of these eighteen resulting composite material sample pieces, again both at room temperature and at a high temperature of approximately 250° C.

In more detail, first a set of six quantities, denoted hereinafter as E1 through E6, of mixed hybrid fiber material were made as before by mixing together crystalline alumina-silica short fiber material and potassium titanate whisker material in the respective relative volume proportions of 1:0, 4:1, 3:2, 2:3, 1:4, and 0:1, i.e. so that the potassium titanate whisker relative volume proportion their was, as before, respectively 0%, 20%, 40%, 60, 80%, and 100%. The composition of each of these six quantities E1 through E6 of mixed hybrid fiber material is further shown in Table 1. Then, from each of these six mixed hybrid fiber material quantities E1 through E6, there were formed three preforms by, in each case, subjecting a quantity of the relevant mixed hybrid fiber material to compression forming; thus, in all, there were eighteen such preforms, as in the fourth set of preferred embodiments described above, and of substantially the same dimensions. However, in this case, the overall mixed hybrid fiber material volume proportion in each of said preforms, in this fifth set of preferred embodiments of the composite material of the present invention, was only approximately 10%. Next, substantially as before, each of these mixed hybrid short fiber material preforms was subjected to high pressure casting together with an appropriate quantity of one of the aluminum alloys JIS standard AC1A or JIS standard AC4C or JIS standard AC7A described above, utilizing in each case operational parameters substantially as before; and in each case the resulting solidified aluminum alloy mass with its preform included in it was removed from the casting mold, and was machined to leave a sample piece of composite material which had a mixture of crystalline alumina-silica short fiber material and potassium titanate whisker material as reinforcing material and the appropriate one of the aluminum alloys JIS standard AC1A or JIS standard AC4C or JIS standard AC7A as matrix metal. And post processing steps were performed on these composite material samples, substantially as before. The overall volume proportion of the hybrid short fiber material in each of these bending strength test sample pieces was thus now approximately 10%. From each of the composite material sample pieces manufactured as described above, to which heat treatment had been applied, there was cut a bending strength test piece of dimensions and parameters substantially as in the case of the fourth set of preferred embodiments described above, and for each of these composite material bending strength test pieces a bending strength test was carried out under substantially the same conditions and in substantially the same manner as before, i.e. twice: once with the temperature of the composite material bending strength test pieces being room temperature and once with the temperature of said composite material bending strength test pieces being approxmately 250° C.

Figure 11:
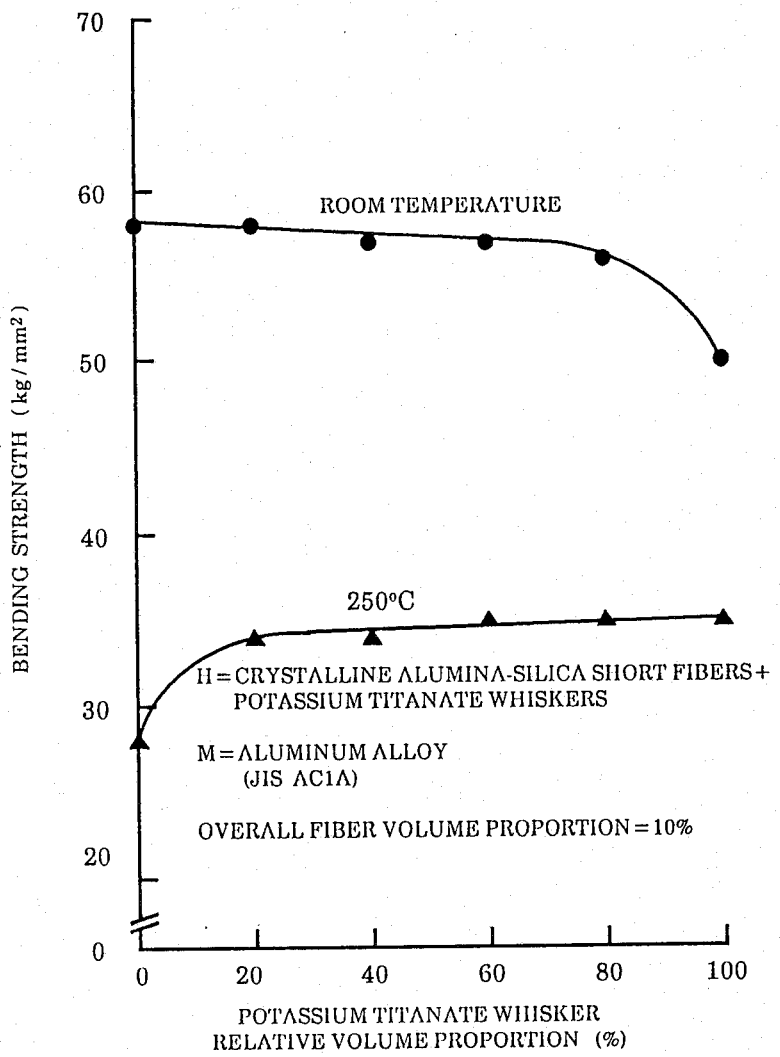
FIG. 11 is a set of two graphs in which again potassium titanate whisker relative volume proportion in percent is shown along the horizontal axis and bending strength in kg/mm$^2$ is shown along the vertical axis, similar to FIG. 1 for the first group of the first set of preferred embodiments, derived from data relating to bending strength tests for a first group of the fifth set of preferred embodiment of the material of the present invention, in which the matrix metal was again aluminum alloy of JIS standard AC1A, the volume proportion of reinforcing mixed hybrid fiber material was now approximately 10%, and the fiber material which was admixtured to the potassium titanate whiskers to make said mixed hybrid fiber material was again crystalline alumina-silica fiber material, with the hybrid fibers incorporated in said mixed hybrid fiber material again being aligned substantially randomly in two dimensions while being layered in the third dimension perpendicular to said two dimensions, one of said graphs showing the relation between potassium titanate whisker relative volume proportion and bending strength of the composite material test pieces at room temperature and the other of said graphs showing the relation between potassium titanate whisker relative volume proportion and bending strength of the composite material test pieces at a high temperature of approximately 250° C.
Figure 12:
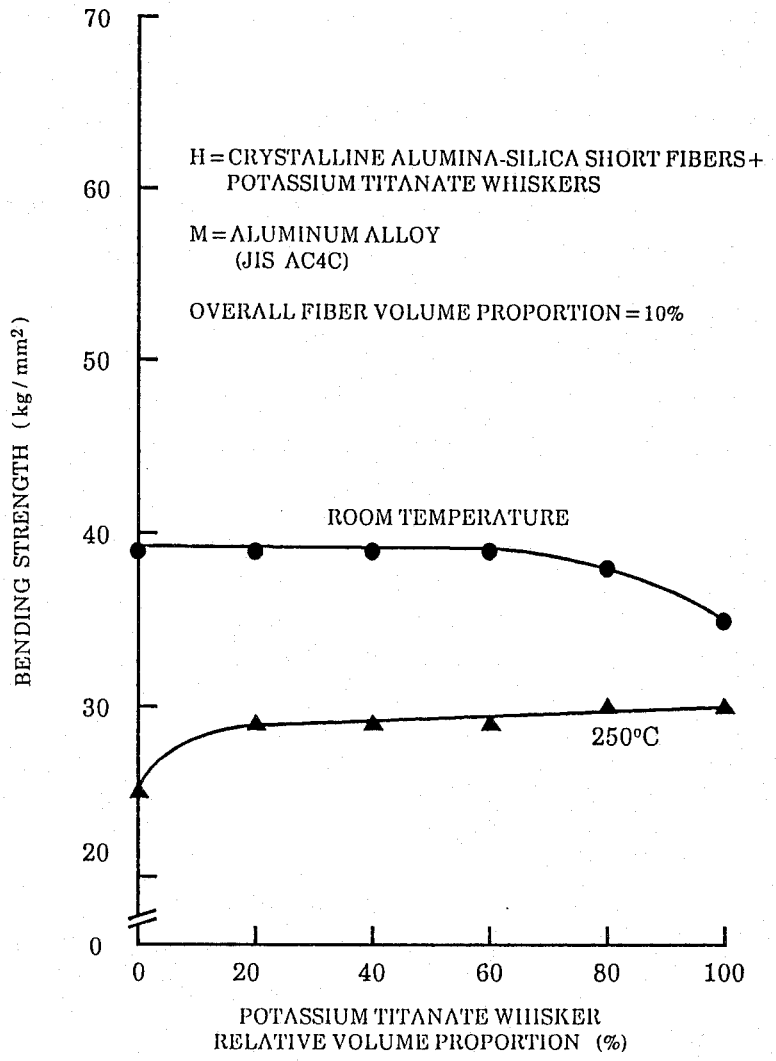
FIG. 12 is a set of two graphs in which again potassium titanate whisker relative volume proportion in percent is shown along the horizontal axis and bending strength in kg/mm$^2$ is shown along the vertical axis, similar to FIG. 11 for the first group of this fifth set of preferred embodiments, derived from data relating to bending strength tests for a second group of said fifth set of preferred embodiments of the material of the present invention, in which the matrix metal was now aluminum alloy of JIS standard AC4C, the volume proportion of reinforcing mixed hybrid fiber material was again approximately 10%, and the fiber material which was admixtured to the potassium titanate whiskers to make said mixed hybrid fiber material was again crystalline alumina-silica fiber material, with the hybrid fibers incorporated in said mixed hybrid fiber material again being aligned substantially randomly in two dimensions while being layered in the third dimension perpendicular to said two dimensions, one of said graphs showing the relation between potassium titanate whisker relative volume proportion and bending strength of the composite material test pieces at room temperature and the other of said graphs showing the relation between potassium titanate whisker relative volume proportion and bending strength of the composite material test pieces at a high temperature of approximately 250° C.
Figure 13:
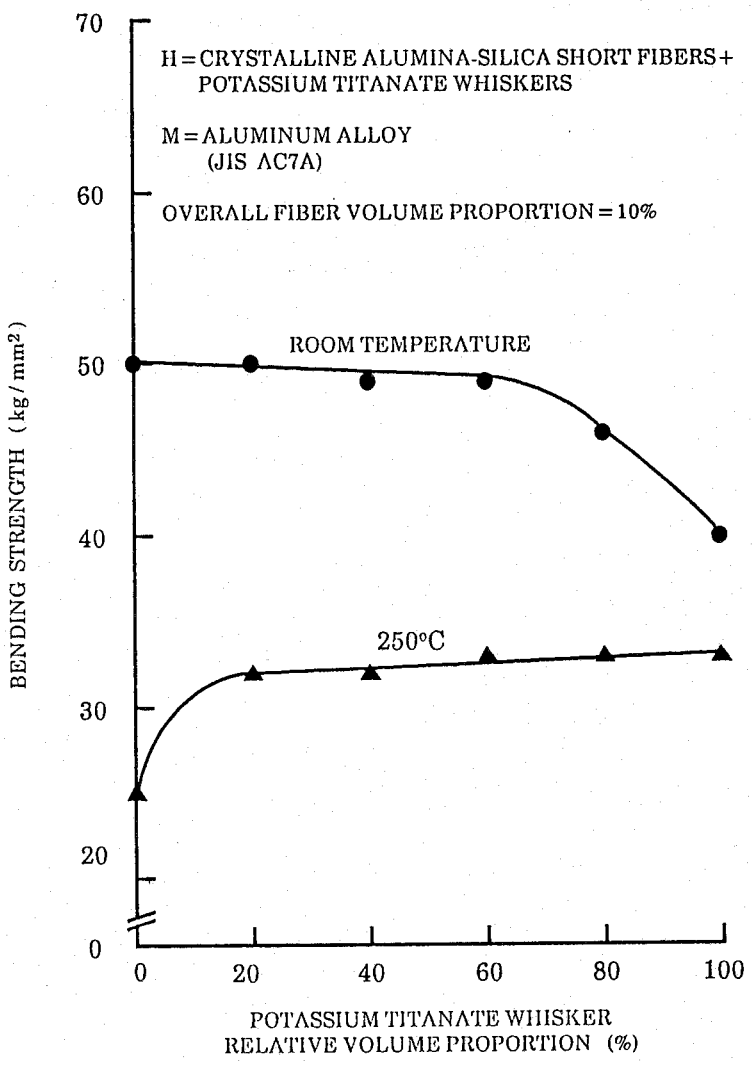
FIG. 13 is a set of two graphs in which again potassium titanate whisker relative volume proportion in percent is shown along the horizontal axis and bending strength in kg/mm$^2$ is shown along the vertical axis, similar to FIG. 11 for the first group of this fifth set of preferred embodiments and to FIG. 12 for the second group of said fifth preferred embodiment set, derived from data relating to bending strength tests for a third group of said fifth set of preferred embodiments of the material of the present invention, in which the matrix metal was now aluminum alloy of JIS standard AC7A, the volume proportion of reinforcing mixed hybrid fiber material was again approximately 10%, and the fiber material which was admixtured to the potassium titanate whiskers to make said mixed hybrid fiber material was again crystalline alumina-silica fiber material, with the hybrid fibers incorporated in said mixed hybrid fiber material again being aligned substantially randomly in two dimensions while being layered in the third dimension perpendicular to said two dimensions, one of said graphs showing the relation between potassium titanate whisker relative volume proportion and bending strength of the composite material test pieces at room temperature and the other of said graphs showing the relation between potassium titanate whisker relative volume proportion and bending strength of the composite material test pieces at a high temperature of approximately 250° C.

The results of these bending strength tests were as shown in Part 5 of the appended Table 2, and as summarized in the line graphs of FIGS. 11 through 13, which relate to the cases of the aluminum alloy matrix metal being of the type JIS standard AC1A, being of the type JIS standard AC4C, and being of the type JIS standard AC7A, respectively. The first through the third portions of Part 5 of Table 2 show, for the respective cases of the aluminum alloy matrix metal being of the type JIS standard AC1A, being of the type JIS standard AC4C, and being of the type JIS standard AC7A, the values of the bending strength (in kg/mm$^2$) for each of the test sample pieces made from the preforms made from the mixed hybrid fiber materials designated as E1 through E6, both at room temperature and at high temperature. And each of the line graphs of FIG. 11 shows the relation between the potassium titanate whisker relative volume proportion (in percent) shown along the horizontal axis and the bending strength (in kg/mm$^2$) shown along the vertical axis of those of said composite material test pieces having as matrix metal aluminum alloy JIS standard AC1A, and having as reinforcing material the above specified mixed hybrid fiber material in volume proportion of 10%; each of the line graphs of FIG. 12 likewise shows the relation between the potassium titanate whisker relative volume proportion (in percent) shown along the horizontal axis and the bending strength (in kg/mm$^2$) shown along the vertical axis of those of said composite material test pieces having as matrix metal aluminum alloy JIS standard AC4C, and having as reinforcing material the above specified mixed hybrid fiber material in volume proportion of 10%; and each of the line graphs of FIG. 13 similarly the relation between the potassium titanate whisker relative volume proportion (in percent) shown along the horizontal axis and the bending strength (in kg/mm$^2$) shown along the vertical axis of those of said composite material test pieces having as matrix metal aluminum alloy JIS standard AC7A, and having as reinforcing material the above specified mixed hybrid fiber material in volume proportion of 10%.

From Part 5 of Table 2 and From FIGS. 11 through 13 it will be understood that for all of these composite materials, whichever aluminum alloy of the three ones detailed was used as the matrix metal, when the relative volume proportion of the potassium titanate whiskers included in the mixed hybrid reinforcing fiber material of these composite material bending strength test sample pieces was less than about 70%, and especially when said potassium titanate whisker relative volume proportion was less than about 60%, the bending strength of the composite material test sample pieces at room temperature was substantially the same as or near that of composite material test sample pieces which had as reinforcing fibers only crystalline alumina-silica short fiber material; in other words, the potassium titanate whiskers did not substantially deteriorate the bending strength at room temperature of said composite material test sample pieces. On the other hand, in the range of potassium titanate whisker relative volume proportion greater than about 70%, and particularly in the range of potassium titanate whisker relative volume proportion greater than about 80%, it will further be seen that the bending strength of the composite material test sample pieces at room temperature decreased rapidly as the potassium titanate whisker relative volume proportion increased. Yet further, it will be seen that, for all of these composite materials, again whichever aluminum alloy of the three ones detailed was used as the matrix metal, when the relative volume proportion of the potassium titanate whiskers included in the mixed hybrid reinforcing fiber material of these composite material bending strength test sample pieces was from about 0% to about 20%, and especially when said potassium titanate whisker relative volume proportion was from about 0% to about 10%, the bending strength of the composite material test sample pieces at relatively high temperature was relatively low, and further increased rapidly as the potassium titanate whisker relative volume proportion increased; and, in the range where said potassium titanate whisker relative volume proportion was greater than about 10%, and particularly in the range where said potassium titanate whisker relative volume proportion was greater than about 20%, said bending strength at high temperature of said composite material test sample pieces was substantially the same as or was near that of composite material test sample pieces which had as reinforcing fibers only potassium titanate whisker material; in other words, in this high temperature case, the crystalline alumina-silica short fibers did not substantially deteriorate the bending strength of said composite material test sample pieces.

From the results of these bending strength tests it will be seen that, in order to provide for a good and appropriate bending strength both at room temperatures and at relatively high temperatures for a composite material having as its reinforcing fiber material such as hybrid short fiber mixture of crystalline alumina-silica short fiber material and potassium titanate whiskers at an overall hybrid fiber volume proportion now of approximately 10% and having as its matrix metal an aluminum alloy such as JIS standard AC1A or JIS standard AC4C or JIS standard AC7A or the like, it is preferable for the relative volume proportion of the potassium titanate whiskers in said reinforcing hybrid fiber material to be in the range of from approximately 10% to approximately 80%, or more preferably to be in the range of from approximately 10% to approximately 70%, or even more preferably to be in the range of from approximately 20% to approximately 60%.

THE SIXTH SET OF PREFERRED EMBODIMENTS (hybrid fibers-mixture of alumina whiskers and potassium titanate whiskers; matrix metal-magnesium alloy; overall fiber volume proportion 30%)

Next, the present inventors manufactured six further bending strength test samples of various composite materials, now utilizing as reinforcing material a hybrid short fiber material containing potassium titanate whisker material and, this time, alumina short fiber material, mixed together in six different relative volume proportions, and utilizing as matrix metal a magnesium alloy of JIS standard MC2, and this time employing an overall hybrid fiber volume proportion of approximately 30%. Then the present inventors again conducted evaluations of the bending strength of these six resulting composite material sample pieces, again both at room temperature and at a high temperature of approximately 250° C.

In more detail, first a set of six quantities, denoted hereinafter as F1 through F6, of mixed hybrid fiber material were made by mixing together alumina short fiber material and potassium titanate whisker material in the respective relative volume proportions of 1:0, 4:1, 3:2, 2:3, 1:4, and 0:1, i.e so that the potassium titanate whisker relative volume proportion therein was, as before, respectively 0%, 20%, 40%, 60%, 80%, and 100%. The alumina short fibers were of a type which was manufactured by ICI Corporation, which consisted of approximately 95% by weight of delta-$Al_2O_3$ with balance substantially $SiO_2$, and which had average fiber length of about 2 mm and average fiber diameter of about 3 microns, and the potassium titanate whisker material was substantially the same as that used in the various sets of preferred embodiments detailed above. The composition of each of these six quantities F1 through F6 of mixed hybrid fiber material is further shown in Table 1. Then, from each of these six mixed hybrid fiber material quantities F1 through F6, there was formed a preform by, in each case, subjecting a quantity of the relevant mixed hybrid fiber material to compression forming; thus, in al, there were six such preforms, each like the preforms of the first set of preferred embodiments described above, and of substantially the same dimensions. In this case, the overall mixed hybrid fiber material volume proportion in each of said preforms, in this sixth set of preferred embodiments of the composite material of the present invention, was approximately 30%. Next, substantially as before, each of these mixed hybrid short fiber material preforms was subjected to high pressure casting together with an appropriate quantity of the magnesium alloy JIS standard MC2 described above, utilizing in each case operational parameters substantially as before, except that the temperature of the molten magnesium alloy was 690° C., and the heat treatments applied to the composite material sample pieces were solution treatment at a temperature of 420° C. for approximately 16 hours and artificial aging processing at a temperature 215° C. of for approximately 4 hours; and in each case the resulting solidified magnesium alloy mass with its preform included in it was removed from the casting mold, and was machined to leave a sample piece of composite material which had a mixture of alumina short fiber material and potassium titanate whisker material as reinforcing material and the magnesium alloy JIS standard MC2 as matrix metal. The overall volume proportion of the hybrid short fiber material in each of these bending strength test sample pieces was thus approximately 30%. From each of the composite material sample pieces manufactured as described above, to which heat treatment had been applied, there was cut a bending strength test piece of dimensions and parameters substantially as in the case of the sets of preferred embodiments described above, and for each of these composite material bending strength test pieces a bending strength test was carried out under substantially the same conditions and in substantially the same manner as in the fourth set of preferred embodiments described above, i.e. twice: once with the temperature of the composite material bending strength test pieces being room temperature and once with the temperature of said composite material bending strength test pieces being approximately 250° C.

Figure 14:
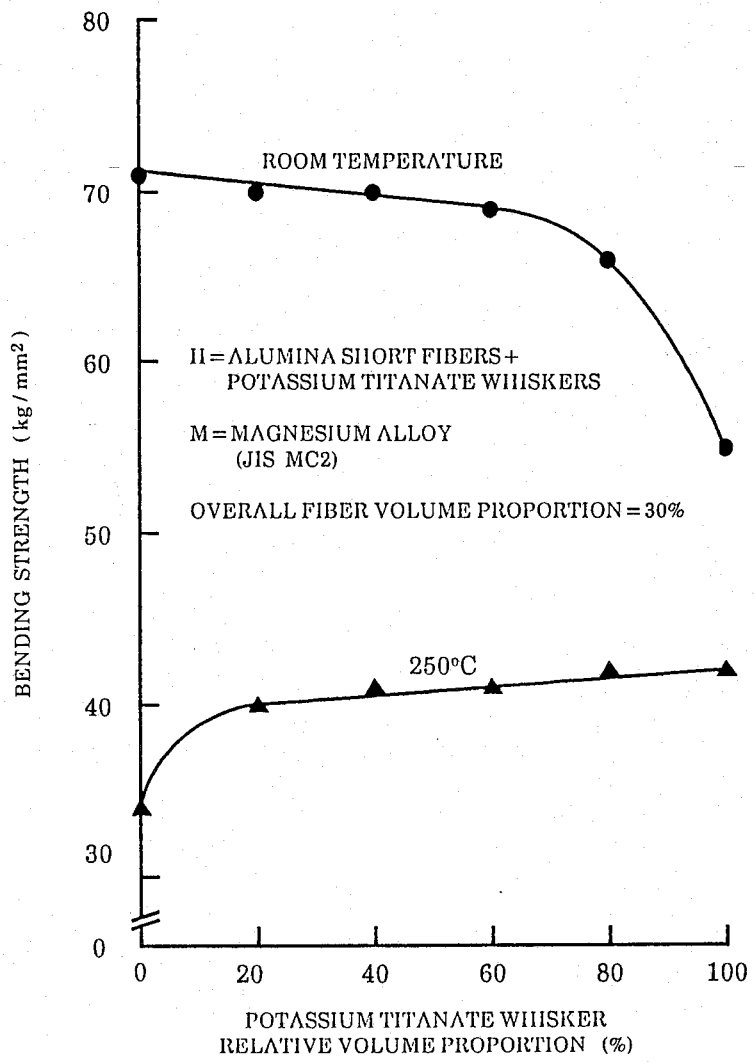
FIG. 14 is a set of two graphs in which again potassium titanate whisker relative volume proportion in percent is shown along the horizontal axis and bending strength in kg/mm$^2$ is shown along the vertical axis, similar to FIG. 1 for the first group of the first set of preferred embodiments, derived from data relating to bending strength tests for the sixth set of preferred embodiments of the material of the present invention, in which the matrix metal was now magnesium alloy of JIS standard MC2, the volume proportion of reinforcing mixed hybrid fiber material was now approximately 30%, and the fiber material which was admixtured to the potassium titanate whiskers to make said mixed hybrid fiber material was now alumina short fibers, with the hybrid fibers incorporated in said mixed hybrid fiber material again being aligned substantially randomly in two dimensions while being layered in the third dimension perpendicular to said two dimensions, one of said graphs showing the relation between potassium titanate whisker relative volume proportion and bending strength of the composite material test pieces at room temperature and the other of said graphs showing the relation between potassium titanate whisker relative volume proportion and bending strength of the composite material test pieces at a high temperature of approximately 250° C.

The results of these bending strength tests were as shownin Part 6 of the appended Table 2, and as summarized in the line graphs of FIG. 14. Part 6 of Table 2 shows the values of the bending strength (in kg/mm$^2$) for each of the test sample pieces made from the preforms made from the mixed hybrid fiber materials designated as F1 through F6, both at room temperature and at high temperature. And each of the line graphs of FIG. 14 shows the relation between the potassium titanate whisker relative volume proportion (in percent) shown along the horizontal axis and the bending strength (in kg/mm$^2$) shown along the vertical axis of certain of these composite material test pieces having as matrix metal magnesium alloy JIS standard MC2 and having as reinforcing material the above specified mixed hybrid fiber material in volume proportion of 30%.

From Part 6 of Table 2 and from FIG. 14 it will be understood that, for these composite materials, when the relative volume proportion of the potassium titanate whisker included in the mixed hybrid reinforcing fiber material of these composite material bending strength test sample pieces was less than about 70%, and especially when said potassium titanate whisker relative volume proportion was less than about 60%, the bending strength of the composite material test sample pieces at room temperature was substantially the same as or near that of composite material test sample pieces which had as reinforcing fibers only alumina short fiber material; in other words, the potassium titanate whiskers did not substantially deteriorate the bending strength at room temperature of said composite material test sample pieces. On the other hand, in the range of potassium titanate whisker relative volume proportion greater than about 70%, and particularly in the range of potassium titanate whisker relative volume proportion greater than about 80%, it will further be seen that the bending strength of the composite material test sample pieces at room temperature descreased rapidly as the potassium titanate whisker relative volume proportion increased. Yet further, it will be seen that, for these composite materials, when the relative volume proportion of the potassium titanate whisker included in the mixed hybrid reinforcing fiber material of these composite material bending strength test sample pieces was from about 0% to about 20%, and especially when said potassium titanate whisker relative volume proportion was from about 0% to about 10%, the bending strength of the composite material test sample pieces at relatively high temperature was relatively low, and further increased rapidly as the potassium titanate whisker relative volume proportion increased; and, in the range where said potassium titanate whisker relative volume proportion was greater than about 10%, and particularly in the range where said potassium titanate whisker relative volume proportion was greater than about 20%, said bending strength at high temperature of said composite material test sample pieces was substantially the same as or was near that of composite material test sample pieces which had as reinforcing fiber material only potassium titanate whisker material; in other words, in this high temperature case, the alumina short fibers did not substantially deteriorate the bending strength of said composite material test sample pieces.

From the results of these bending strength tests it will be seen that, in order to provide for a good and appropriate bending strength both at room temperatures and at relatively high temperatures for a composite material having as its reinforcing fiber material such as hybrid short fiber mixture of alumina short fiber material and potassium titanate whiskers at an overall hybrid fiber volume proportion of approximately 30% and having as its matrix metal a magnesium alloy such as JIS standard MC2 or the like, it is preferably for the relative volume proportion of the potassium titanate whiskers in said reinforcing hybrid fiber material to be in the range of from approximately 10% to approximately 80%, or more preferably to be in the range of from approximately 10% to approximately 70%, or even more preferably to be in the range of from approximately 20% to approximately 60%.

THE SEVENTH SET OF PREFERRED EMBODIMENTS (hybrid fibers-mixture of amorphous alumina-silica short fibers and potassium titanate whiskers; matrix metal-alumina alloy; overall fiber volume proportion 10%)

Next, the present inventors manufactured six further bending strength test samples of various composite materials, now utilizing as reinforcing material a hybrid short fiber material containing potassium titanate whisker material and, this time, amorphous alumina-silica short fiber material, mixed together in six different relative volume proportions, and utilizing as matrix metal an aluminum alloy of JIS standard AC1A, and this time employing an overall hybrid fiber volume proportion of approximately 10%. Then the present inventors again condcted evaluations of the bending strength of these six resulting composite material sample pieces, again both at room temperature and at a high temperature of approximately 250° C.

In more detail, first a set of six quantities, denoted hereinafter as G1 through G6, of mixed hybrid fiber material were made by mixing together amorphous alumina-silica short fiber material and potassium titanate whisker material in the respective relative volume proportions of 1:0, 4:1, 3:2, 2:3, 1:4, and 0:1, i.e so that the potassium titanate whisker relative volume proportion therein was, as before, respectively 0%, 20%, 40%, 60%, 80%, and 100%. The amorphous alumina-silica short fibers were of a type which was manufactured by Isolite Babcock Taika K.K., which consisted of approximately 49% by weight of $Al_2O_3$ with balance substantially $SiO_2$, and which had average fiber length of about 3 mm and average fiber diameter of about 3 microns, and the potassium titanate whisker material was substantially the same as that used in the various sets of preferred embodiments previously detailed above. The composition of each of these six quantities G1 through G6 of mixed hybrid fiber material is further shown in Table 1. Then, from each of these six mixed hybrid fiber material quantities G1 through G6, there was formed a preform by, in each case, subjecting a quantity of the relevant mixed hybrid fiber material to compression forming; thus, in all, there were six such preforms, each like the preforms of the sets of preferred embodiments described above, and of substantially the same dimensions. In this case, the overall mixed hybrid fiber material volume proportion in each of said preforms, in this seventh set of preferred embodiments of the composite material of the present invention, was approximately 10%. Next, substantially as before, each of these mixed hybrid short fiber material preforms was subjected to high pressure casting together with an appropriate quantity of the aluminum alloy JIS standard AC1A described above, utilizing in each case operational parameters substantially as in the case of previously described sets of preferred embodiments; and in each case the resulting solidified aluminum alloy mass with its preform included in it was removed from the casting mold, and was machined to leave a sample piece of composite material which had a mixture of amorphous alumina-silica short fiber material and potassium titanate whisker material as reinforcing material and the aluminum alloy JIS standard AC1A as matrix metal. The overall volume proportion of the hybrid short fiber material in each of these bending strength test sample pieces was thus approximately 10%. From each of the composite material sample pieces manufactured as described above, to which heat treatment had been applied, there was cut a bending strength test piece of dimensions and parameters substantially as in the case of the sets of preferred embodiments described above, and for each of these composite material bending strength test pieces a bending strength test was carried out under substantially the same conditions and in substantially the same manner as in the fourth set of preferred embodiments described above, i.e. twice: once with the temperature of the composite material bending strength test pieces being room temperature and once with the temperature of said composite material bending strength test pieces being approximately 250° C.

Figure 15:
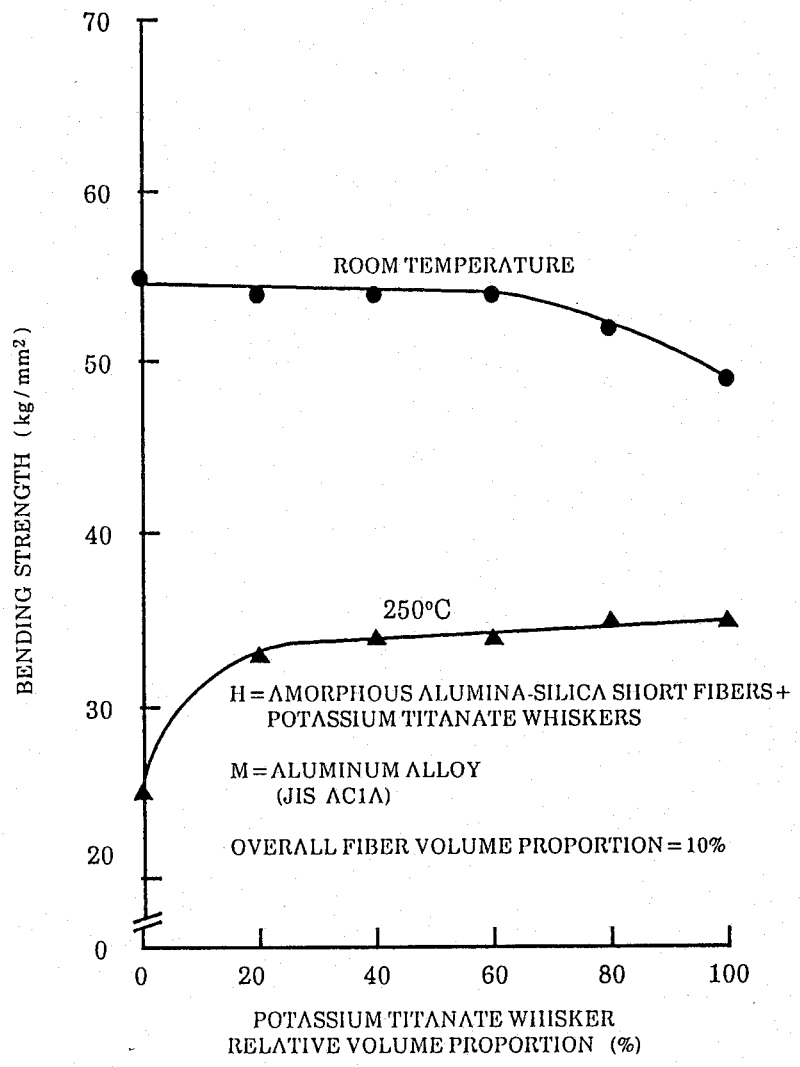
FIG. 15 is a set of two graphs in which again potassium titanate whisker relative volume proportion in percent is shown along the horizontal axis and bending strength in kg/mm$^2$ is shown along the vertical axis, similar to FIG. 1 for the first group of the first set of preferred embodiments, derived from data relating to bending strength tests for the seventh set of preferred embodiments of the material of the present invention, in which the matrix metal was now aluminum alloy of JIS standard AC1A, the volume proportion of reinforcing mixed hybrid fiber material was now approximately 10%, and the fiber material which was admixtured to the potassium titanate whiskers to make said mixed hybrid fiber material was now amorphous alumina-silica short fibers, with the hybrid fibers incorporated in said mixed hybrid fiber material again being aligned substantially randomly in two dimensions while being layered in the third dimension perpendicular to said two dimensions, one of said graphs showing the relation between potassium titanate whisker relative volume proportion and bending strength of the composite material test pieces at room temperature and the other of said graphs showing the relation between potassium titanate whisker relative volume proportion and bending strength of the composite material test pieces at a high temperature of approximately 250° C.

The results of these bending strength tests were as shown in Part 7 of the appended Table 2, and as summarized in the line graphs of FIG. 15. Part 7 of Table 2 shows the values of the bending strength (in $kg/mm^2$)

for each of the test sample pieces made from the preforms made from the mixed hybrid fiber materials designated as G1 through G6, both at room temperature and at high temperature. And each of the line graphs of FIG. 15 shows the relation between the potassium titanate whisker relative volume proportion (in percent) shown along the horizontal axis and the bending strength (in kg/mm$^2$) shown along the vertical axis of certain of these composite material test pieces having as matrix metal aluminum alloy JIS standard AC1A and having as reinforcing material the above specified mixed hybrid fiber material in volume proportion of 10%.

From Part 7 of Table 2 and from FIG. 15 it will be understood that, for these composite materials, when the relative volume proportion of the potassium titanate whisker included in the mixed hybrid reinforcing fiber material of these composite material bending strength test sample pieces was less than about 70%, and especially when said potassium titanate whisker relative volume proportion was less than about 60%, the bending strength of the composite material test sample pieces at room temperature was substantially the same as or near that of composite material test sample pieces which had as reinforcing fibers only amorphous alumina-silica short fiber material; in other words, the potassium titanate whiskers did not substantially deteriorate the bending strength at room temperature of said composite material test sample pieces. On the other hand, in the range of potassium titanate whisker relative volume proportion greater than about 70%, and particularly in the range of potassium titanate whisker relative volume proportion greater than about 80%, it will further be seen that the bending strength of the composite material test sample pieces at room temperature decreased rapidly as the potassium titanate whisker relative volume proportion increased. Yet further, it will be seen that, for these composite materials, when the relative volume proportion of the potassium titanate whisker included in the mixed hybrid reinforcing fiber material of these composite material bending strength test sample pieces was from about 0% to about 20%, and especially when said potassium titanate whisker relative volume proportion was from about 0% to about 10%, the bending strength of the composite material test sample pieces at relatively high temperature was relatively low, and further increased rapidly as the potassium titanate whisker relative volume proportion increased; and, in the range where said potassium titanate whisker relative volume proportion was greater than about 10%, and particularly in the range where said potassium titanate whisker relative volume proportion was greater than about 20%, said bending strength at high temperature of said composite material test sample pieces was substantially the same as or was near that of composite material test sample pieces which had as reinforcing fiber material only potassium titanate whisker material; in other words, in this high temperature case, the amorphous alumina-silica short fibers did not substantially deteriorate the bending strength of said composite material test sample pieces.

From the results of these bending strength tests it will be seen that, in order to provide for a good and appropriate bending strength both at room temperatures and at relatively high temperatures for a composite material having as its reinforcing fiber material such a hybrid short fiber mixture of amorphous alumina-silica short fiber material and potassium titanate whiskers at an overall hybrid fiber volume proportion of approximately 10% and having as its matrix metal a aluminum alloy such as JIS standard AC1A or the like, it is preferable for the relative volume proportion of the potassium titanate whiskers in said reinforcing hybrid fiber material to be in the range of from approximately 10% to approximately 80%, or more preferably to be in the range of from approximately 10% to approximately 70%, or even more preferably to be in the range of from approximately 20% to approximately 60%.

THE EIGHTH SET OF PREFERRED EMBODIMENTS (hybrid fibers-mixture of mullite crystalline alumina short fibers and potassium titanate whiskers; matrix metal-aluminum alloy; overall fiber volume proportion 10)

Next, the present inventors manufactured six further bending strength test samples of various composite materials, now utilizing as reinforcing material a hybrid short fiber material containing potassium titanate whisker material and, this time, mullite crystalline alumina short fiber material, mixed together in six different relative volume proportions, and utilizing as matrix metal an aluminum alloy of JIS standard AC1A, and this time again employing an overall hybrid fiber volume proportion of approximately 10%. Then the present inventors again conducted evaluations of the bending strength of these six resulting composite material sample pieces, again both at room temperature and at a high temperature of approximately 250° C.

In more detail, first a set of six quantities, denoted hereinafter as H1 through H6, of mixed hybrid fiber material were made by mixing together mullite crystalline alumina short fiber material and potassium titanate whisker material in the respective relative volume proportions of 1:0, 4:1, 3:2, 2:3, 1:4, and 0:1, i.e. so that the potassium titanate whisker relative volume proportion therein was, as before, respectively 0%, 20%, 40%, 60%, 80%, and 100%. The mullite crystalline alumina short fibers were of a type which was manufactured by Mitsubishi Kasei K.K., which consisted of approximately 80% by weight of $Al_2O_3$ with balance substantially $SiO_2$, and which had average fiber length of about 150 microns and average fiber diameter of about 3 microns, and the potassium titanate whisker material was substantially the same as that used in the various sets of preferred embodiments previously detailed above. The composition of each of these six quantities H1 through H6 of mixed hybrid fiber material is further shown in Table 1. Then, from each of these six mixed hybrid fiber material quantities H1 through H6, there was formed a preform by, in each case, subjecting a quantity of the relevant mixed hybrid fiber material to compression forming; thus, in all, there were six such preforms, each like the preforms of the sets of preferred embodiments described above, and of substantially the same dimensions. In this case, the overall mixed hybrid fiber material volume proportion in each of said preforms, in this eighth set of preferred embodiments of the composite material of the present invention, was approximately 10%. Next, substantially as before, each of these mixed hybrid short fiber material preforms was subjected to high pressure casting together with an appropriate quantity of the aluminum alloy JIS standard AC1A described above, utilizing in each case operational parameters substantially as in the case of previously described sets of preferred embodiments; and in each case the resulting solidified aluminum alloy mass with its preform included in it was removed from the casting mold, and was machined to leave a sample piece of composite material which had a mixture of mullite crystalline alumina short fiber material and potassium titanate whisker material as reinforcing material and the aluminum alloy JIS standard AC1A as matrix metal. The overall volume proportion of the hybrid short fiber material in each of these bending strength test sample pieces was thus approximately 10%. From each of the composite material sample pieces manufactured as described above, to which heat treatment had been applied, there was cut a bending strength test piece of dimensions and parameters substantially as in the case of the sets of preferred embodiments described above, and for each of these composite material bending strength test pieces a bending strength test was carried out under substantially the same conditions and in substantially the same manner as in the fourth set of preferred embodiments described above, i.e. twice: once with the temperature of the composite material bending strength test pieces being room temperature and once with the temperature of said composite material bending strength test pieces being approximately 250° C.

Figure 16:
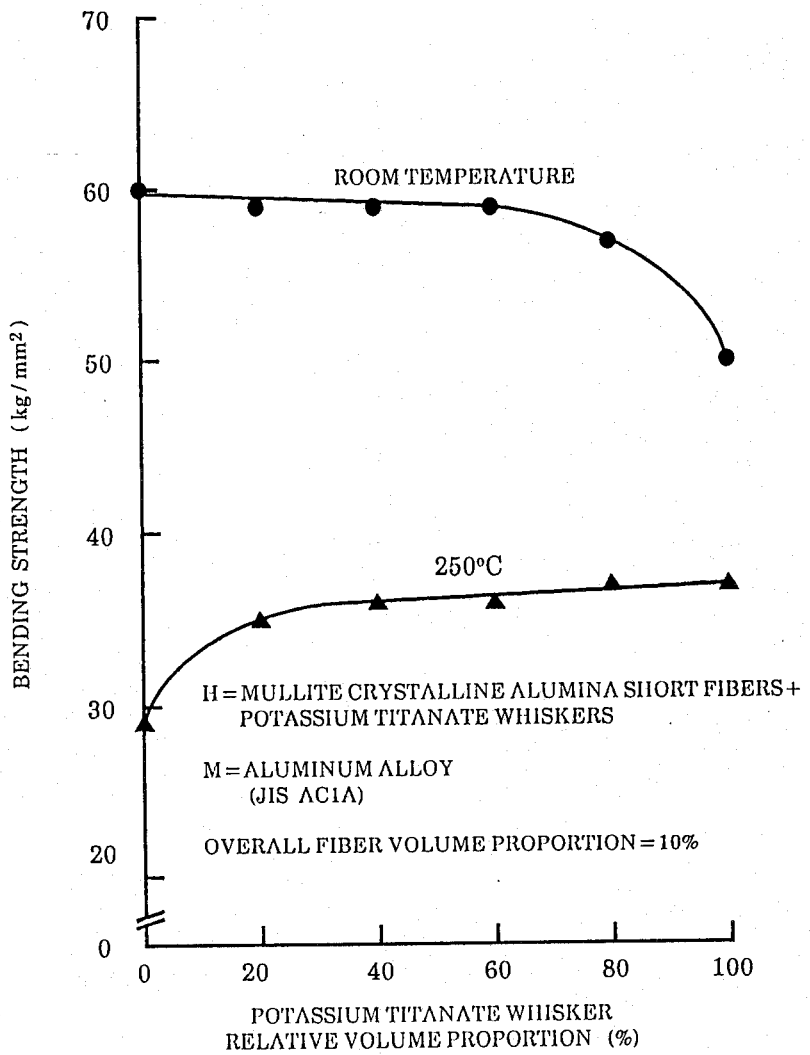
FIG. 16 is a set of two graphs in which again potassium titanate whisker relative volume proportion in percent is shown along the horizontal axis and bending strength in $kg/mm^2$ is shown along the vertical axis, similar to FIG. 1 for the first group of the first set of preferred embodiments, derived from data relating to bending strength tests for the eighth set of preferred embodiments of the material of the present invention, in which the matrix metal was again aluminum alloy of JIS standard AC1A, the volume proportion of reinforcing mixed hybrid fiber material was again approximately 10%, and the fiber material which was admixtured to the potassium titanate whiskers to make said mixed hybrid fiber material was now mullite crystalline alumina short fibers, with the hybrid fibers incorporated in said mixed hybrid fiber material again being aligned substantially randomly in two dimensions while being layered in the third dimension perpendicular to said two dimensions, one of said graphs showing the relation between potassium titanate whisker relative volume proportion and bending strength of the composite material test pieces at room temperature and the other of said graphs showing the relation between potassium titanate whisker relative volume proportion and bending strength of the composite material test pieces at a high temperature of approximately 250° C.

The results of these bending strength tests were as shown in Part 8 of the appended Table 2, and as summarized in the line graphs of FIG. 16. Part 8 of Table 2 shows the values of the bending strength (in kg/mm$^2$) for each of the test sample pieces made from the preforms made from the mixed hybrid fiber materials designated as H1 through H6, both at room temperature and at high temperature. And each of the line graphs of FIG. 16 shows the relation between the potassium titanate whisker relative volume proportion (in percent) shown along the horizontal axis and the bending strength (in kg/mm$^2$) shown along the vertical axis of certain of these composite material test pieces having as matrix metal aluminum alloy JIS standard AC1A and having as reinforcing material the above specified mixed hybrid fiber material in volume proportion of 10%.

From Part 8 of Table 2 and from FIG. 16 it will be understood that, for these composite materials, when the relative volume proportion of the potassium titanate whisker included in the mixed hybrid reinforcing fiber material of these composite material bending strength test sample pieces was less than about 70%, and especially when said potassium titanate whisker relative volume proportion was less than about 60%, the bending strength of the composite material test sample pieces at room temperature was substantially the same as that of composite material test sample pieces which had as reinforcing fibers only mullite crystalline alumina short fiber material; in other words, the potassium titanate whiskers did not substantially deteriorate the bending strength at room temperature of said composite material test sample pieces. On the other hand, in the range of potassium titanate whisker relative volume proportion greater than about 70%, and particularly in the range of potassium titanate whisker relative volume proportion greater than about 80%, it will further be seen that the bending strength of the composite material test sample pieces at room temperature decreased rapidly as the potassium titanate whisker relative volume proportion increased. Yet further, it will be seen that, for these composite materials, when the relative volume proportion of the potassium titanate whisker included in the mixed hybrid reinforcing fiber material of these composite material bending strength test sample pieces was from about 0% to about 20%, and especially when said potassium titanate whisker relative volume proportion was from about 0% to about 10%, the bending strength of the composite material test sample pieces at relatively high temperature was relatively low, and further increased rapidly as the potassium titanate whisker relative volume proportion increased; and, in the range where said potassium titanate whisker relative volume proportion was greater than about 10%, and particularly in the range where said potassium titanate whisker relative volume proportion was greater than about 20%, said bending strength at high temperature of said composite material test sample pieces was substantially the same as or was near that of composite material test sample pieces which had as reinforcing fiber material only potassium titanate whisker material; in other words, in this high temperature case, the mullite crystalline alumina short fibers did not substantially deteriorate the bending strength of said composite material test sample pieces.

From the results of these bending strength tests it will be seen that, in order to provide for a good and appropriate bending strength both at room temperatures and at relatively high temperatures for a composite material having as its reinforcing fiber material such a hybrid short fiber mixture of mullite crystalline alumina short fiber material and potassium titanate whiskers at an overall hybrid fiber volume proportion of approximately 10% and having as its matrix metal a aluminum alloy such as JIS standard AC1A or the like, it is preferable for the relative volume proportion of the potassium titanate whiskers in said reinforcing hybrid fiber material to be in the range of from approximately 10% to approximately 80%, or more preferably to be in the range of from approximately 10% to approximately 70%, or even more preferably to be in the range of from approximately 20% to approximately 60%.

THE NINTH SET OF PREFERRED EMBODIMENTS

Variation of fiber volume proportion

Since from the above described first through eighth sets of preferred embodiments the fact had been amply established and demonstrated that it is preferable for the relative volume proportion of the potassium titanate whiskers in the reinforcing hybrid fiber material to be in the range of from approximately 10% to approximately 80%, or more preferably to be in the range of from approximately 10% to approximately 70%, or even more preferably to be in the range of from approximately 20% to approximately 60%, it next was deemed germane to provide a set of tests to establish what overall fiber volume proportion of the reinforcing mixed hybrid type short fiber material might be most appropriate. This was done, in the ninth set of preferred embodiments now to be described, by varying said fiber volume proportion of the reinforcing mixed hybrid type short fiber material, while employing a potassium titanate whisker relative volume proportion which had as described above been established as being quite good, i.e. which had given good results in the sets of tests described above. In fact, this potassium titanate whisker relative volume proportion was 40%. In other words, an appropriate number (in fact thirty—i.e., six of each) of preforms made of the five various materials used in the preferred embodiments detailed above were made by subjecting quantities of said short fiber materials having a potassium titanate whisker relative volume proportion of 40% to compression forming without using any binder, in the same manner as in the above described sets of preferred embodiments, the six ones in each of said five sets of mixed hybrid type short fiber material preforms having fiber volume proportions of approximately 5%, 10%, 20%, 30%, 40%, and 50%. These preforms had substantially the same dimensions and the same type of three dimensional random fiber orientation as the respectively corresponding preforms of the above described first through eighth sets of preferred embodiments. And, substantially as before, each of these mixed hybrid type short fiber material preforms was subjected to high pressure casting together with an appropriate quantity of the JIS standard AC1A aluminum alloy matrix metal described above, utilizing operational parameters substantially as detailed previously with regard to the first set of preferred embodiments in the cases of those of the preforms which were made of mixed hybrid type short fiber material including silicon nitride or silicon carbide whiskers, and substantially as detailed previously with regard to the fourth set of preferred embodiments in the cases of those of the preforms which were made of mixed hybrid type short fiber material including reinforcing fibers other than such silicon nitride or silicon carbide whiskers. In each case, the solidified aluminum alloy mass with the preform included therein was then removed from the casting mold, and as before the peripheral portion of said solidified aluminum alloy mass was machined away along with the stainless steel case which had been utilized, leaving only a sample piece of composite material which had mixed hybrid short fiber type short fiber material as reinforcing material in the appropriate fiber volume proportion and had the described aluminum alloy as matrix metal. And post processing and artificial aging processing steps were performed on the composite material samples, similarly to what was done before. From each of the composite material sample pieces manufactured as described above, to which heat treatment had been applied, there was then cut a bending strength test piece, each of dimensions substantially as in the case of the above described sets of preferred embodiments, and for each of these composite material bending strength test pieces a bending strength test was carried out, again substantially as in the case of the first set of preferred embodiments, or as in the case of the fourth set of preferred embodiments, respectively. The results of these bending strength tests were as shown in the graph of FIG. 17; this graph shows, for each case of each particular type of short fiber material admixtured to the potassium titanate whisker to form the mixed hybrid short fiber type reinforcing material, the relation between the overall volume proportion of said mixed hybrid short fiber type reinforcing material and the bending strength (in $kg/mm^2$) of the various composite material test pieces.

Figure 17:
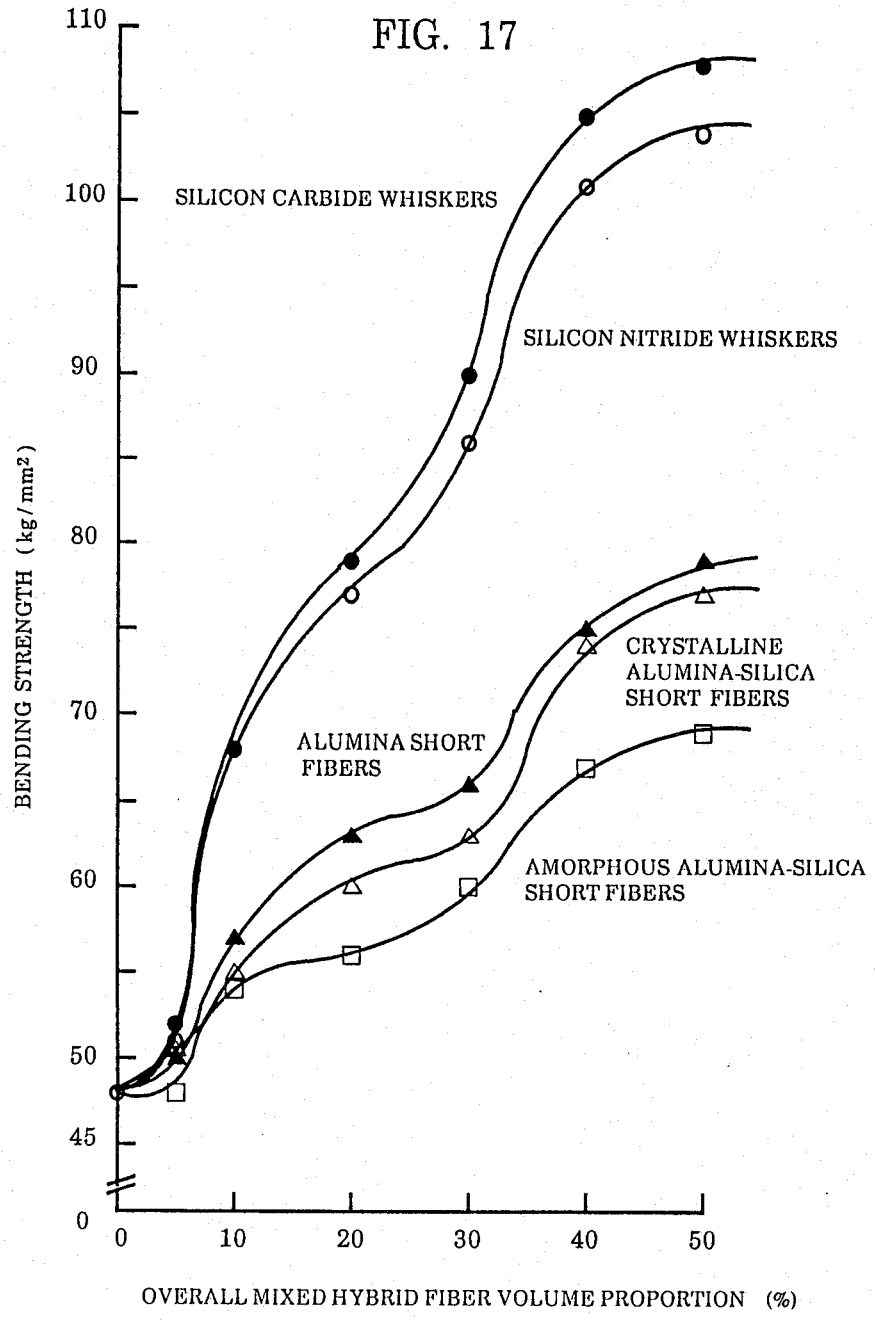
FIG. 17 is a graph relating to a set of tests in which the overall fiber volume proportion of the reinforcing mixed hybrid fiber material was varied, for various cases of different types of short fiber material being admixtured to the potassium titanate whiskers to make said mixed hybrid fiber material, in which said overall reinforcing fiber volume proportion in percent is shown along the horizontal axis and bending strength in $kg/mm^2$ is shown along the vertical axis, derived from data relating to bending strength tests for a ninth set of preferred embodiments of the material of the present invention.

From FIG. 17, it will be understood that, virtually irrespective of the particular type of short fiber material admixtured to the potassium titanate whisker to form the mixed hybrid short fiber type reinforcing material, although in all ranges, as the overall volume proportion of said mixed hybrid short fiber type reinforcing material increased, the bending strength of the composite material increased along therewith, nevertheless: when the overall volume proportion of said mixed hybrid short fiber type reinforcing material was in the range of up to and including approximately 5% the bending strength of the composite material did not increase very quickly along with an increase in said overall reinforcing fiber volume proportion; when said overall volume proportion of said mixed hybrid short fiber type reinforcing material was in the range of from approximately 5% to approximately 40% the bending strength of the composite material in fact did increase relatively quickly along with an increase in said overall reinforcing fiber volume proportion, and this was particularly pronounced when said overall volume proportion of said mixed hybrid short fiber type reinforcing material was in the range of from approximately 10% to approximately 40% (and especially in the particular sub-ranges of from approximately 5% to approximately 10% and from approximately 30% to approximately 40%); while, further, when the overall volume proportion of said mixed hybrid short fiber type reinforcing material was in the range of above approximately 40%, and particularly when it was in the range of above approximately 50%, the bending strength of the composite material did not increase very quickly along with any further increase in said overall reinforcing fiber volume proportion. From these results described above, and in view of the desirability of utilizing as little reinforcing fiber as practicable in order to minimize cost of the resulting composite material, so as to obtain a material which is as strong as possible at a cost which is as low as possible, it is seen that in a composite material having mixed hybrid short fiber type reinforcing material and having as matrix metal an aluminum or magnesium alloy, it is preferable that the overall fiber volume proportion of said short fiber type reinforcing material should be in the range of from approximately 5% to approximately 50%, and more preferably should be in the range of from approximately 5% to approximately 40%, and even more preferably should be in the range of from approximately 10% to approximately 40%.

CONCLUSION

Although the present invention has been shown and described in terms of the preferred embodiments thereof, and with reference to the various experiments detailed above as being carried out by the present inventors and with reference to the appended drawings, it should not be considered as being particularly limited thereby, since the details of any particular embodiment, or of the drawings, could be varied without, in many cases, departing from the ambit of the present invention. For example, although in the various sets of preferred embodiments described above, in each case, only one single type of short fiber material was admixtured to the potassium titanate whisker, in order to produce the mixed hybrid type short fiber material which was used as reinforcing fiber material for the composite material sample pieces, it is considered from the results of the various experiments detailed above to be clear that it would be acceptable for said mixed hybrid type short fiber material for use as reinforcing fiber material to contain more than one single type of short fiber material admixtured to it, along with the potassium titanate whisker fibers which it contains. Further, it is considered that various other types of light metals (by which, in this specification, light alloys are also to be understood) would be suitable as the matrix metal, for a composite material according to the present invention. Other variations could be conceived of. Accordingly, the scope of the present invention is to be considered as being delimited, not by any particular perhaps entirely fortuitous details of the disclosed preferred embodiments, or of the drawings, but solely by the scope of the accompanying claims, which follow after the Tables.

TABLE 1

| Sample Name | Potassium Titanate Whisker Relative Volume Proportion | Type of Admixtured Short Fibers | Relative Volume Proportion | Overall Fiber Volume Proportion |
|---|---|---|---|---|
| A1 | 0 | Silicon Nitride Whiskers | 100 | 30 |
| A2 | 20 | Silicon Nitride Whiskers | 80 | " |
| A3 | 40 | Silicon Nitride Whiskers | 60 | " |
| A4 | 60 | Silicon Nitride Whiskers | 40 | " |
| A5 | 80 | Silicon Nitride Whiskers | 20 | " |
| A6 | 100 | Silicon Nitride Whiskers | 0 | " |
| B1 | 0 | Silicon Nitride Whiskers | 100 | 10 |
| B2 | 20 | Silicon Nitride Whiskers | 80 | " |
| B3 | 40 | Silicon Nitride Whiskers | 60 | " |
| B4 | 60 | Silicon Nitride Whiskers | 40 | " |
| B5 | 80 | Silicon Nitride Whiskers | 20 | " |
| B6 | 100 | Silicon Nitride Whiskers | 0 | " |
| C1 | 0 | Silicon Carbide Whiskers | 100 | 30 |
| C2 | 20 | Silicon Carbide Whiskers | 80 | " |
| C3 | 40 | Silicon Carbide Whiskers | 60 | " |
| C4 | 60 | Silicon Carbide Whiskers | 40 | " |
| C5 | 80 | Silicon Carbide Whiskers | 20 | " |
| C6 | 100 | Silicon Carbide Whiskers | 0 | " |
| D1 | 0 | Crystalline Alumina-Silica Short Fibers | 100 | " |
| D2 | 20 | Crystalline Alumina-Silica Short Fibers | 80 | " |
| D3 | 40 | Crystalline Alumina-Silica Short Fibers | 60 | " |
| D4 | 60 | Crystalline Alumina-Silica Short Fibers | 40 | " |
| D5 | 80 | Crystalline Alumina-Silica Short Fibers | 20 | " |
| D6 | 100 | Crystalline Alumina-Silica Short Fibers | 0 | " |
| E1 | 0 | Crystalline Alumina-Silica Short Fibers | 100 | 10 |
| E2 | 20 | Crystalline Alumina-Silica Short Fibers | 80 | " |
| E3 | 40 | Crystalline Alumina-Silica Short Fibers | 60 | " |
| E4 | 60 | Crystalline Alumina-Silica Short Fibers | 40 | " |
| E5 | 80 | Crystalline Alumina-Silica Short Fibers | 20 | " |
| E6 | 100 | Crystalline Alumina-Silica Short Fibers | 0 | " |
| F1 | 0 | Alumina Short Fibers | 100 | 30 |
| F2 | 20 | Alumina Short Fibers | 80 | " |
| F3 | 40 | Alumina Short Fibers | 60 | " |
| F4 | 60 | Alumina Short Fibers | 40 | " |
| F5 | 80 | Alumina Short Fibers | 20 | " |
| F6 | 100 | Alumina Short Fibers | 0 | " |

TABLE 1-continued

| Sample Name | Potassium Titanate Whisker Relative Volume Proportion | Type of Admixtured Short Fibers | Relative Volume Proportion | Overall Fiber Volume Proportion |
|---|---|---|---|---|
| G1 | 0 | Amorphous Alumina-Silica Short Fibers | 100 | 10 |
| G2 | 20 | Amorphous Alumina-Silica Short Fibers | 80 | " |
| G3 | 40 | Amorphous Alumina-Silica Short Fibers | 60 | " |
| G4 | 60 | Amorphous Alumina-Silica Short Fibers | 40 | " |
| G5 | 80 | Amorphous Alumina-Silica Short Fibers | 20 | " |
| G6 | 100 | Amorphous Alumina-Silica Short Fibers | 0 | " |
| H1 | 0 | Mullite Crystalline Alumina Short Fibers | 100 | " |
| H2 | 20 | Mullite Crystalline Alumina Short Fibers | 80 | " |
| H3 | 40 | Mullite Crystalline Alumina Short Fibers | 60 | " |
| H4 | 60 | Mullite Crystalline Alumina Short Fibers | 40 | " |
| H5 | 80 | Mullite Crystalline Alumina Short Fibers | 20 | " |
| H6 | 100 | Mullite Crystalline Alumina Short Fibers | 0 | " |

TABLE 2

| Hybrid Fiber Sample Name | Matrix Metal | Strength At Room Temperature | Strength At High Temperature |
|---|---|---|---|
| | PART I | | |
| A1 | JIS AC1A | 88 | 40 |
| A2 | " | 87 | 46 |
| A3 | " | 86 | 47 |
| A4 | " | 85 | 47 |
| A5 | " | 81 | 47 |
| A6 | " | 59 | 47 |
| A1 | JIS AC4C | 57 | 27 |
| A2 | " | 56 | 32 |
| A3 | " | 56 | 32 |
| A4 | " | 55 | 32 |
| A5 | " | 50 | 32 |
| A6 | " | 40 | 32 |
| A1 | JIS AC7A | 75 | 31 |
| A2 | " | 75 | 36 |
| A3 | " | 74 | 37 |
| A4 | " | 73 | 37 |
| A5 | " | 69 | 38 |
| A6 | " | 55 | 38 |
| | PART 2 | | |
| B1 | JIS AC1A | 68 | 30 |
| B2 | " | 68 | 34 |
| B3 | " | 68 | 34 |
| B4 | " | 67 | 35 |
| B5 | " | 64 | 35 |
| B6 | " | 49 | 35 |
| B1 | JIS AC4C | 47 | 26 |
| B2 | " | 47 | 30 |
| B3 | " | 46 | 30 |
| B4 | " | 46 | 30 |
| B5 | " | 43 | 30 |
| B6 | " | 35 | 30 |
| B1 | JIS AC7A | 58 | 27 |
| B2 | " | 58 | 32 |
| B3 | " | 57 | 32 |
| B4 | " | 57 | 33 |
| B5 | " | 54 | 33 |
| B6 | " | 40 | 33 |
| | PART 3 | | |
| C1 | JIS MC2 | 76 | 36 |
| C2 | " | 75 | 41 |
| C3 | " | 74 | 41 |
| C4 | " | 73 | 42 |

TABLE 2-continued

| Hybrid Fiber Sample Name | Matrix Metal | Strength At Room Temperature | Strength At High Temperature |
|---|---|---|---|
| C5 | " | 69 | 42 |
| C6 | " | 54 | 42 |
| | PART 4 | | |
| D1 | JIS AC1A | 67 | 36 |
| D2 | " | 67 | 45 |
| D3 | " | 66 | 46 |
| D4 | " | 66 | 46 |
| D5 | " | 64 | 47 |
| D6 | " | 59 | 47 |
| D1 | JIS AC4C | 44 | 26 |
| D2 | " | 44 | 31 |
| D3 | " | 44 | 32 |
| D4 | " | 44 | 32 |
| D5 | " | 43 | 32 |
| D6 | " | 40 | 32 |
| D1 | JIS AC7A | 62 | 30 |
| D2 | " | 61 | 37 |
| D3 | " | 61 | 37 |
| D4 | " | 61 | 38 |
| D5 | " | 59 | 38 |
| D6 | " | 55 | 38 |
| | PART 5 | | |
| E1 | JIS AC1A | 58 | 28 |
| E2 | " | 58 | 34 |
| E3 | " | 57 | 34 |
| E4 | " | 57 | 35 |
| E5 | " | 55 | 35 |
| E6 | " | 50 | 35 |
| E1 | JIS AC4C | 39 | 25 |
| E2 | " | 39 | 29 |
| E3 | " | 39 | 29 |
| E4 | " | 39 | 29 |
| E5 | " | 38 | 30 |
| E6 | " | 35 | 30 |
| E1 | JIS AC7A | 50 | 25 |
| E2 | " | 50 | 32 |
| E3 | " | 49 | 32 |
| E4 | " | 49 | 33 |
| E5 | " | 46 | 33 |
| E6 | " | 40 | 33 |
| | PART 6 | | |
| F1 | JIS MC2 | 71 | 34 |
| F2 | " | 70 | 40 |
| F3 | " | 70 | 41 |
| F4 | " | 69 | 41 |
| F5 | " | 66 | 42 |
| F6 | " | 55 | 42 |
| | PART 7 | | |
| G1 | JIS AC1A | 55 | 25 |
| G2 | " | 54 | 33 |
| G3 | " | 54 | 34 |
| G4 | " | 54 | 34 |
| G5 | " | 52 | 35 |
| G6 | " | 49 | 35 |
| | PART 8 | | |

TABLE 2-continued

| Hybrid Fiber Sample Name | Matrix Metal | Strength At Room Temperature | Strength At High Temperature |
|---|---|---|---|
| H1 | JIS AC1A | 60 | 29 |
| H2 | " | 59 | 35 |
| H3 | " | 59 | 36 |
| H4 | " | 59 | 36 |
| H5 | " | 57 | 37 |
| H6 | " | 50 | 37 |

What is claimed is:

1. In a composite material comprising a matrix of a light metal and a reinforcing fiber material selected from the group consisting of silicon carbide whiskers, silicon nitride whiskers, alumina short fibers, crystalline alumina-silica short fibers, amorphous alumina-silica short fibers and mixtures thereof, the improvement for substantially increasing the bending strength of the composite material at an elevated temperature without substantially affecting bending strength of the composite material at room temperature, comprising mixing potassium titanate whiskers with said reinforcing fiber material at a volumetric ratio relative to said reinforcing fiber material of about 10–80% and limiting the volumetric ratio of the total reinforcing fiber material in the composite material to between about 5 and 50%.

2. A composite material according to claim 1 wherein said elevated temperature is sufficient whereby said potassium titanate whiskers react with said light metal matrix to enhance adherence thereof to said matrix.

3. A composite material according to claim 1 wherein said elevated temperature is about 250° C.

4. A composite material according to claim 1, wherein said matrix metal is aluminum alloy.

5. A composite material according to claim 1, wherein said matrix metal is magnesium alloy.

6. A composite material according to claim 1 or 4 or 3, wherein the overall volume proportion of said reinforcing fiber material in said composite material is from about 5% to about 40%.

7. A composite material according to claim 6, wherein the overall volume proportion of said reinforcing fiber material in said composite material is from about 10% to about 40%.

8. A composite material according to claim 1 or 4 or 5, wherein the relative volume proportion of said potassium titanate whiskers in said reinforcing fiber material is from about 10% to about 70%.

9. A composite material according to claim 8, wherein the relative volume proportion of said potassium titanate whiskers in said reinforcing fiber material is from about 20% to about 60%.

* * * * *